US010847117B1

(12) United States Patent
Rhodes, Jr. et al.

(10) Patent No.: US 10,847,117 B1
(45) Date of Patent: Nov. 24, 2020

(54) CONTROLLING AN AUGMENTED REALITY DISPLAY WITH TRANSPARENCY CONTROL USING MULTIPLE SETS OF VIDEO BUFFERS

(71) Applicant: Adobe Inc., San Jose, CA (US)

(72) Inventors: Tenell Glen Rhodes, Jr., San Jose, CA (US); Gavin Stuart Peter Miller, Los Altos, CA (US); Li-Yi Wei, Redwood City, CA (US); Qi Sun, Santa Clara, CA (US)

(73) Assignee: Adobe Inc., San Jose, CA (US)

( * ) Notice: Subject to any disclaimer, the term of this patent is extended or adjusted under 35 U.S.C. 154(b) by 0 days.

(21) Appl. No.: 16/410,630

(22) Filed: May 13, 2019

(51) Int. Cl.
*G09G 3/36* (2006.01)
*G09G 5/02* (2006.01)
*G09G 5/00* (2006.01)

(52) U.S. Cl.
CPC ..... *G09G 5/026* (2013.01); *G09G 5/006* (2013.01); *G09G 2320/0247* (2013.01); *G09G 2320/0666* (2013.01); *G09G 2340/125* (2013.01); *G09G 2360/18* (2013.01)

(58) Field of Classification Search
None
See application file for complete search history.

(56) References Cited

U.S. PATENT DOCUMENTS 6,603,482 B1 * 8/2003 Tidwell ..... G06T 15/005 345/426
10,181,299 B1 * 1/2019 Miller ..... F21V 14/003
2005/0166214 A1 * 7/2005 Kaulgud ..... G06F 3/1446 719/321
2007/0159488 A1 * 7/2007 Danskin ..... G06T 15/005 345/505
2010/0097293 A1 * 4/2010 McMahon ..... B60K 35/00 345/1.1
2014/0192281 A1 * 7/2014 Smithwick ..... H04N 13/395 349/15
2015/0264298 A1 * 9/2015 Colenbrander ..... G06F 3/14 345/547

(Continued)

OTHER PUBLICATIONS

Smithwick, Quinn. "A switched emissive transparent display with controllable per-pixel opacity." Journal of the Society for Information Display 24.9 (2016): 537-544.*

(Continued)

*Primary Examiner* — Sultana M Zalalee
(74) *Attorney, Agent, or Firm* — SBMC

(57) ABSTRACT

An augmented reality display alternates between displaying color frames and alpha frames to generate composite images for transparency control. A display processor includes two sets of buffers, each set including a color frame buffer and an alpha frame buffer. One set of buffers is used to provide data to the display while new video data is being written into the other set of buffers. The display processor switches which set of buffers is providing data and which set of buffers is having new video data written into them. By switching the alpha and color frame buffers in sets, a pair of color frame buffer and alpha frame buffer are always the current set of buffers to provide data as the output. If a frame drop occurs and the next color frame or alpha frame is not ready, the set of buffers is not switched to avoid disturbing flashing visual artifacts.

20 Claims, 18 Drawing Sheets

(56) References Cited

U.S. PATENT DOCUMENTS

| | | | | |
|---|---|---|---|---|
| 2015/0310668 | A1* | 10/2015 | Ellerbrock | H04N 5/32 345/633 |
| 2017/0041598 | A1* | 2/2017 | Smithwick | H04N 13/30 |
| 2018/0130432 | A1* | 5/2018 | Cui | G02F 1/133602 |

OTHER PUBLICATIONS

"Cave automatic virtual environment—Wikipedia", Retrieved at: https://en.wikipedia.org/wiki/Cave_automatic_virtual_environment—on Jan. 29, 2019, 3 pages.
"Quadro Quad Buffered Professional Stereo Technology", Retrieved at: https://www.nvidia.com/object/quadro_stereo_technology_in.html—on Feb. 15, 2019, 5 pages.
"Porter/Duff Compositing and Blend Modes", Retrieved at: http://ssp.impulsetrain.com/porterduff.html, Mar. 2013, 6 pages.
"ASUS ROG Swift PG258Q—Gaming Monitor", Retrieved at: https://www.amazon.com/gp/product/B06WRP3F5S/—on Feb. 15, 2019, 9 pages.
Cheng,"Sparse Haptic Proxy: Touch Feedback in Virtual Environments Using a General Passive Prop", May 11, 2017, 11 pages.
Lee,"SpaceTop: Integrating 2D and Spatial 3D Interactions in a See-through Desktop Environment", Apr. 2013, pp. 189-192.
Lindlbauer,"Tracs: Transparency Control for See-through Displays", Oct. 2014, 6 pages.
Smith,"NVIDIA Announces 3D Vision 2 Glasses and 3D LightBoost Technology", Retrieved at: https://www.anandtech.com/show/4966/nvidia-announces-3d-vision-2-and-3d-lightboost-technology, Oct. 14, 2011, 6 pages.
Sun,"Towards Virtual Reality Infinite Walking: Dynamic Saccadic Redirection", Aug. 2018, 13 pages.
Weichel,"MixFab: A Mixed-Reality Environment for Personal Fabrication", Apr. 26, 2014, 10 pages.
"A Switched Emissive Transparent Display with Controllable per-pixel Opacity", Disney Research Studios—Retrieved at: https://studios.disneyresearch.com/2016/09/29/a-switched-emissive-transparent-display-with-controllable-per-pixel-opacity/—on Jul. 29, 2019, Sep. 29, 2016, 5 pages.
Smithwick,"A Switched Emissive Transparent Display with Controllable per-pixel Opacity", Journal of the Society for Information Display 24(9), Sep. 29, 2016, 10 pages.

* cited by examiner

CONTROLLING AN AUGMENTED REALITY DISPLAY WITH TRANSPARENCY CONTROL USING MULTIPLE SETS OF VIDEO BUFFERS

BACKGROUND

As computer technology has advanced, computers have become increasingly commonplace in our lives and have found a wide variety of different uses. One such use is augmented reality ("AR") displays. AR displays are display devices that a user can see through but on which the computer can also display graphics, allowing the display of virtual graphics over physical objects in real time.

One type of AR display alternates between displaying color frames and alpha frames. Color frames include the virtual graphics to be displayed, and alpha frames are masks that correspond to the virtual graphics. Situations can arise where a frame is dropped for any of a variety of different reasons, such as rendering complexity for the virtual graphics, video decoding, file reading, physical disturbance of the AR display, and so forth. In the event of a frame drop, the same color frame or alpha frame may be displayed again. This can cause objectionable artifacts because the color frames typically have very different content than the alpha frames. For example, bright regions of a color frame are usually matched by black regions in the corresponding alpha frame. Any frame drops can result in a color frame being displayed again instead of an intended alpha frame, or result in an alpha frame being displayed again instead of an intended color frame. Given the very different content of alpha frames and color frames, the display of a color frame rather than an intended alpha frame, or the display of an alpha frame rather than an intended color frame, can appear as bright flashes to the user. These noticeable flashes occur because a given region of the image may have a very different appearance in the transparency (alpha) frame and the color frame. Since the alpha frame encodes the transparency of a region directly in a color value, a purely transparent region will have an emissive color of black and a transparency color of white. Double showing a transparency mask image will cause that region of the display to flash brightly. Double showing a color image will cause that region of the display to darken excessively. For an opaque white region of the display, the converse applies. Double-showing the color image will cause that region of the display to flash brighter, while double showing the transparency mask image will cause that region of the screen to flash darker.

The artifacts caused by these frame drops cause random bright and dark flickering, which can be very objectionable to users and lead to user frustration and dissatisfaction with their AR displays.

SUMMARY

To mitigate the drawbacks of frame drops in augmented reality displays that alternate between displaying color frames and alpha frames, a display processor for controlling a display system that includes two sets of video buffers is described. The display processor includes a first set of video buffers and a second set of video buffers. The first set of video buffers includes a first color frame buffer to store data describing a first color frame of a first emitted light image, and a first alpha frame buffer to store data describing a first transparency mask image that corresponds to the first color frame. The second set of video buffers includes a second color frame buffer to store data describing a second color frame of a second emitted light image and a second alpha frame buffer to store data describing a second transparency mask image that corresponds to the second color frame. A controller of the display processor switches between using the first set of video buffers to display both the first emitted light image and the first transparency mask image and using the second set of video buffers to display both the second emitted light image and the second transparency mask image. A display screen manager of the display processor sequences a display screen of the display system between a first state and a second state, the first state including the display screen being in an emissive state, and the second state including the display screen being in a masking state, the display screen displaying an emitted light image of video content while in the first state, and displaying a transparency mask image of the video data while in the second state, the transparency mask image having approximately a same shape as the emitted light image. A diffuser element manager of the display processor sequences a diffuser element of the display system through the first state and the second state, the first state including the diffuser element being in a scatter state, and the second state including the diffuser element being in a transparent state.

By switching the alpha and color frame buffers in sets, a pair of color frame buffer and alpha frame buffer are always the current set of buffers to provide data as the output. If a frame drop occurs and the next color frame or alpha frame is not ready, the display processor will not switch the set of buffers. This allows the display processor to continue alternating between displaying a color frame and an alpha frame, and avoid displaying a color frame when an alpha frame is expected or displaying an alpha frame when a color frame is expected.

This Summary introduces a selection of concepts in a simplified form that are further described below in the Detailed Description. As such, this Summary is not intended to identify essential features of the claimed subject matter, nor is it intended to be used as an aid in determining the scope of the claimed subject matter.

BRIEF DESCRIPTION OF THE DRAWINGS

The detailed description is described with reference to the accompanying figures. Entities represented in the figures may be indicative of one or more entities and thus reference may be made interchangeably to single or plural forms of the entities in the discussion.

DETAILED DESCRIPTION

Overview

Figure 1:
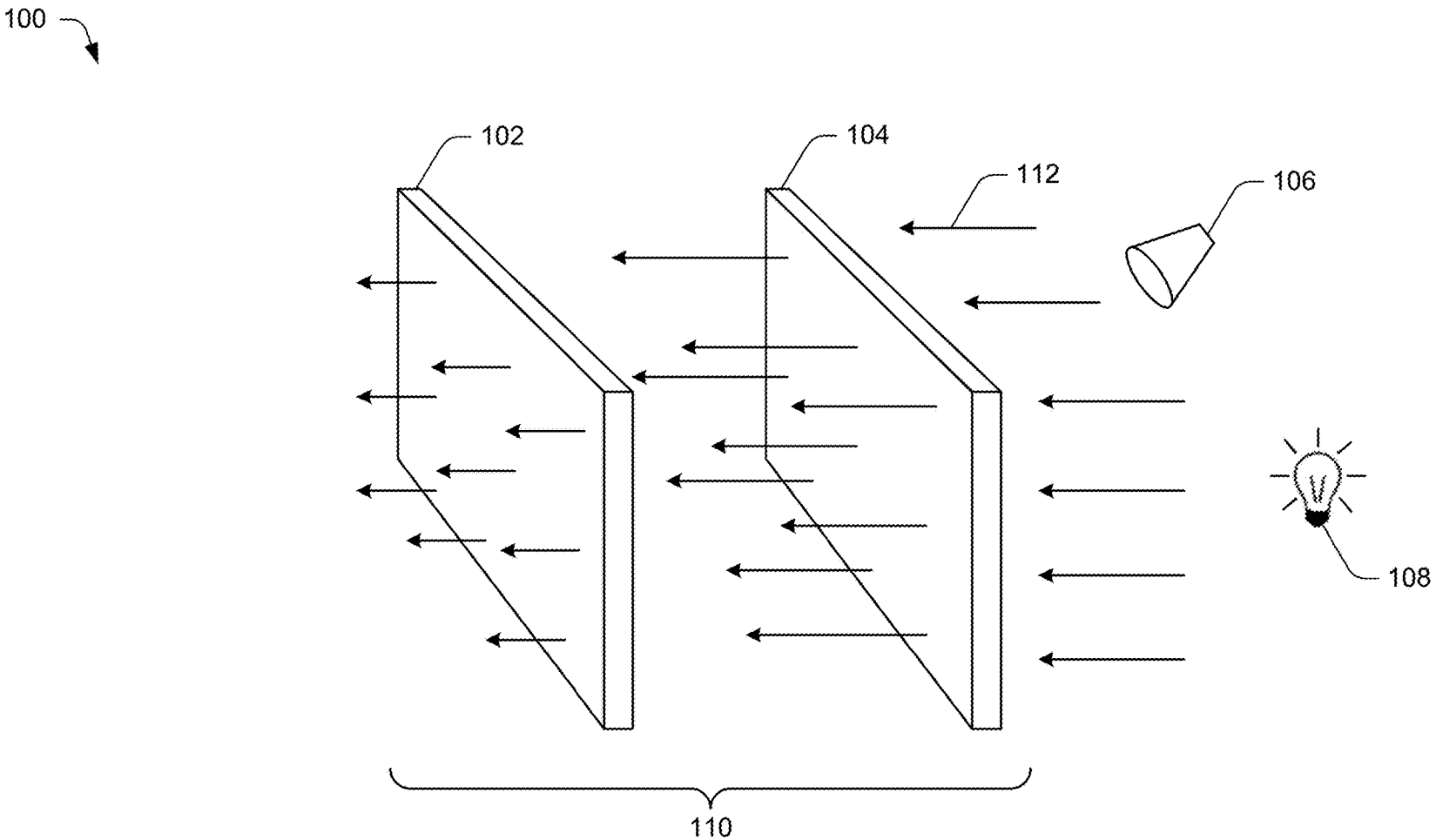
FIG. 1 illustrates an example environment with a display screen in a masking state and a diffuser element in a transparent state.

An AR display implements a digital content overlay system that generates and presents digital overlays on a background view of tangible objects utilizing at least one switchable diffuser with a display screen. In particular, the digital content overlay system generates a digital overlay utilizing the switchable diffuser and a display screen, such as a liquid crystal display ("LCD") screen, by rapidly alternating between an emitted light image and a background view of objects attenuated by a transparency mask image. These objects can be, for example, in a display case. The digital content overlay system can alternate between the emitted light image and the background view attenuated by the transparency mask image at a display rate such that the emitted light image and the background view modified by the transparency mask image generate a composite view with the objects behind the digital content overlay system.

The AR display alternates between displaying color frames (which are data describing the emitted light image) and alpha frames (which are data describing the transparency mask image), and can experience frame drops that can cause objectionable artifacts to be displayed due to the color frames typically having very different content than the alpha frames. For example, bright regions of a color frame are usually matched by black regions in the corresponding alpha frame. Without the use of the multiple frame buffers for both color frames and alpha frames as discussed herein, any frame drops can result in a color frame being displayed again instead of an intended alpha frame, or result in an alpha frame being displayed again instead of an intended color frame, causing bright flashes or flickering. The use of multiple frame buffers for both color frames and alpha frames as discussed herein reduces the random bright flashes or flickering resulting from frame drops as well as reduces synchronization issues between the diffuser and the LCD screen resulting from frame drops.

The display screen displays digital content (e.g., a digital overlay) by filtering various wavelengths of light emanating from one or more light sources located behind the display screen. The display screen alternates, based on a display rate, between an emissive state (where the LCD screen filters light emitted from a diffuser direct light source to display an emitted light image) and a masking state (where the LCD screen filters light from behind the digital content overlay system to display a transparency mask image). Thus, in the emissive state, the display screen can generate an emitted light image and, in the masking state, the display screen can generate a transparency mask image. By alternating between the emissive state and the masking state at the display rate, the digital content overlay system can generate a digital overlay (i.e., a composite of the emitted light image and the transparency mask image modulated background view).

The diffuser element alternates between a transparent state and a scatter state based on the display rate. The diffuser element includes a switchable diffuser that alternates, in response to an electrical stimulus, between a transparent state and a scatter state. Additionally, the digital content overlay system can synchronize the diffuser element with the LCD screen to alternate between the transparent state and the scatter state based on the display rate. For example, the digital content overlay system can alternate the LCD screen and the diffuser element such that, at a first point in time, the LCD screen is in the emissive state and the diffuser element is in the scatter state (such that the LCD screen displays the color image and the diffuser element acts as a backlight), and at a second point in time, the LCD screen is in the masking state and the diffuser element is in the transparent state (such that the LCD screen displays the transparency mask image and the diffuser element acts as a see-through window to objects behind the digital content overlay system). The diffuser element and the LCD screen alternate based on a common display rate that is faster than frequencies perceptible to the human eye, creating a composite view of a digital overlay projected on top of the objects in the background.

In one or more implementations, the display content overlay system includes a display processor that uses four video buffers to generate the content on the LCD screen, also referred to as quad buffering. While in the emissive state, the LCD screen displays color frames, with each color frame being data describing one frame of video that is to be displayed as the emitted light image. While in the masking state, the LCD screen displays alpha frames, with each alpha frame being data describing one frame of video that is to be displayed as the transparency mask image. The color frames and alpha frames are stored in two sets of buffers, each set of buffers including a color frame buffer and an alpha frame buffer.

With two sets of buffers, a color frame buffer or an alpha frame buffer of one set of buffers is used to provide data as the output while the other set of buffers is having new video data written into them. At some point, typically at every other vertical sync (Vsync), the display processor switches which set of buffers is to provide data as the output and which set of buffers is having new video data written into them. Although the display processor switches between sets of buffers, it should be noted that the display processor provides data as the output from only one buffer at a time, switching alternately between a color frame buffer and an alpha frame buffer.

By switching the alpha and color frame buffers in sets, a pair of color frame buffer and alpha frame buffer are always the current set of buffers to provide data as the output. If a frame drop occurs and the next color frame or alpha frame is not ready, the display processor will not switch the set of buffers. This avoids tearing caused by displaying data from two different frames in a single drawing of the display screen. This also results in the current color frame and the current alpha frame being displayed again, and then switching the set of buffers (e.g., at the next Vsync). The display processor thus avoids the situation where an alpha frame is displayed instead of a color frame, or a color frame is displayed instead of an alpha frame.

Displaying color frames instead of alpha frames, or alpha frames instead of color frames can cause significant flashes. These noticeable flashes occur because a given region of the image may have a very different appearance in the alpha frame and the color frame. Since the alpha frame encodes the transparency of a region directly in a color value, a purely transparent region will have an emissive color of black and a transparency color of white. Double showing a transparency mask image will cause that region of the display to flash brightly. Double showing a color image will cause that region of the display to darken excessively. For an opaque white region of the display, the converse applies. Double-showing the color image will cause that region of the display to flash brightly, while double showing the transparency mask image will cause that region of the screen to flash darker.

This darkening or lightening becomes increasingly noticeable to the user the longer color frames are displayed instead of alpha frames, or alpha frames are displayed instead of color frames. By using the two sets of buffers, the display processor avoids darkening or lightening the display. Furthermore, displaying an alpha frame instead of a color frame, or a color frame instead of an alpha frame, can result in what appear to be bright flashes to the viewer. By using the two sets of buffers, the display processor avoids displaying such bright flashes.

In one or more implementations, the display content overlay system includes a display processor that uses eight video buffers to generate the content on the LCD screen, also referred to as Oct buffering. Using eight video buffers allows a stereo display content overlay system to be implemented. Stereo display refers to different images being displayed for the left eye than for the right eye, allowing emitted light images to be viewed as 3-dimensional ("3D") images. In one or more implementations, the display content overlay system is implemented as a stereo display using a shutter system. The shutter system operates to alternate between blocking off the left eye view of the LCD screen so that images for the right eye can be displayed, and blocking off the right eye view of the LCD screen so that images for the left eye can be displayed. Using eight video buffers, quad buffering is implemented for display of data for each of the left eye and the right eye.

The display processor for a stereo display content overlay system includes two sets of frame buffers for each of a left side (used to display images for the left eye) and a right side (used to display images for the right eye). Each set of frame buffers includes a color frame buffer and an alpha frame buffer. The display processor goes through having a sequence of video buffers to provide data as the output to be displayed for the left eye and the right eye. For example, the sequence can be: a color frame buffer for the left eye, then a color frame buffer for the right eye, then an alpha frame buffer for the left eye, then an alpha frame buffer for the right eye. By way of another example, the sequence can be: a color frame buffer for the left eye, then an alpha frame buffer for the left eye, then a color frame buffer for the right eye, then an alpha frame buffer for the right eye. The display processor in the Oct buffering implementation operates analogously to the display processor in the quad buffering implementation, except that the display processor is also switching between video buffers in the left side and the right side as well as, for the left eye view and the right eye view, switching between sets of video buffers.

By switching the alpha and color frame buffers within each of the left side and the right side in sets, a pair of color frame buffer and alpha frame buffer are always the current set of buffers to provide data as the output. If a frame drop occurs and the next color frame or alpha frame within the left side or the right side is not ready, the display processor will not switch the set of buffers within that side. This avoids tearing caused by displaying data from two different frames in a single drawing of the display screen. This also results in the current color frame and the current alpha frame being displayed again, and then switching the set of buffers. The display processor thus avoids the situation where an alpha frame is displayed instead of a color frame, or a color frame is displayed instead of an alpha frame. Additionally, pairing left and right views into sets avoids stereo display problems in which the images are not properly paired for stereo visual consumption.

If the display processor did not use two sets of buffers within each of the left side and the right side, the display processor could provide a color frame as the data for the output when an alpha frame is expected, or provide an alpha frame as the data for the output when a color frame is expected. Use of two sets of buffers within each of the left side and the right side prevents this from happening.

In one or more implementations, the display content overlay system includes a display processor that uses six video buffers to output data to the LCD screen (and optionally the diffuser element), also referred to as hex buffering. The display processor can be configured for use with a diffuser element that is controllable on a pixel-by-pixel basis where individual pixels (or groups of pixels) can be in a scatter state while other pixels are in a transparent state (thus creating a translucency image). Accordingly, the digital content overlay system can toggle the diffuser element using a third state, referred to as a localized translucency state, in addition to the scatter state and the transparent state. By utilizing the localized translucency state, the digital content overlay system can change a level of blur to provide a frosted glass-type overlay by adjusting an amount of scattering done by the diffuser element on a pixel-by-pixel basis.

In particular, the digital content overlay system can control transparency based on a transparency mask image (in a first state), can control color based on an emitted light image (in a second state), and can control translucency based on a translucency image (in a third state). The translucency image controls the transparency of the LCD screen while the diffuser element is in the diffusing (scatter) state and the illumination of the scene is enabled while the direct illumination of the LCD screen is disabled. This gives the effect of letting the LCD screen control which areas appear to be translucent, like frosted glass. Such elements can have degrees of translucency, controlled by the transparency of the attenuating pixels, which allows antialiased or blended edges on the translucent regions. The frosted transparency color can also be controlled by the attenuating display on a per-pixel basis.

By switching between the two sets of buffers, a set of color frame buffer, alpha frame buffer, and translucency frame buffer are always the current set of buffers to provide data as the output of the display processor. If a frame drop occurs and the next color frame, alpha frame, or translucency frame is not ready, the display processor will not switch the set of buffers. In the case where the next color frame or alpha frame is not ready, this avoids tearing caused by displaying data from two different frames in a single drawing of the display screen. This also results in the current color frame, the current alpha frame, and the current translucency frame being displayed again, and then switching the set of buffers. The display processor thus avoids the situations where an alpha frame is displayed instead of a color frame or a translucency frame, a color frame is displayed instead of an alpha frame or a translucency frame, or a translucency frame is displayed instead of a color frame or an alpha frame.

If the display processor did not use two sets of buffers, the display processor could provide a color frame as the data for the output when an alpha frame or a translucency frame is expected, provide an alpha frame as the data for the output when a color frame or translucency frame is expected, or provide a translucency frame as the data for the output when a color frame or an alpha frame is expected. Given the very different content of alpha frames, color frames, and translucency frames, the display of an alpha frame or translucency frame rather than an intended color frame can appear as bright flashes to the user. The display of a color frame or alpha frame rather than an intended translucency frame can result in unintended translucency.

In one or more implementations, a display processor with hex buffering is used to facilitate a camera situated behind the diffuser element capturing an image that is a reflection of the background view off of the display screen. To capture an image that is a reflection of the background view, the LCD screen is in a masking state and the diffuser element is in a transparent state. The LCD screen displays a black screen, causing the background scene to be reflected off the LCD screen and pass through the diffuser element in the transparent state. The camera captures an image of the reflection off the LCD screen and communicates the captured image to a digital overlay manager that generates the emitted light image.

The digital overlay manager generating the emitted light image thus has an image of the background scene and can use this image in any of a variety of different manners. For example, the program can generate an environment map of the background scene and use that environment map when generating the emitted light image to display objects that look as if they are refractive, like water or diamonds. The user could then see through the refractive objects to see the background scene. The emitted light image can also create the appearance of frosted glass by filtering regions of the environment map to compute the color of emissive pixels. By way of another example, the program can use the environment map to determine where to place objects in the emitted light image so that they appear to the user as interacting with the background scene. E.g., the emitted light image can be changed to move the location of a waterfall so that the water appears to be falling into a glass in the background scene.

The display processor repeatedly goes through having a sequence of video buffers to provide the data output, the sequence being a color frame buffer, an alpha frame buffer, and a camera frame buffer. The data from the color frame buffer, the alpha frame buffer, and the camera frame buffer is provided to the display screen. The frame buffers are organized into two sets with one set of buffers being used to provide data as the output while the other set of buffers is having new video data written into them. At some point, typically at every third Vsync, the display processor switches which set of buffers is providing data as the output and which set of buffers is having new video data written into them. Alternatively, since the content of the camera frame is a black image, the camera frame buffer is replaced by custom circuits to generate a black image directly, during that frame time, thus saving memory.

By switching between the two sets of buffers a set of color frame buffer, alpha frame buffer, and optionally camera frame buffer are always the current set of buffers to provide data as the output. If a frame drop occurs and the next color frame, alpha frame, or camera frame is not ready, the display processor will not switch the set of buffers. In the case where the next color frame or alpha frame is not ready, this avoids tearing caused by displaying data from two different frames in a single drawing of the display screen. This also results in the current color frame, the current alpha frame, and the current camera frame being displayed again, and then switching the set of buffers. The display processor thus avoids the situations where an alpha frame is displayed instead of a color frame or a camera frame, a color frame is displayed instead of an alpha frame or a camera frame, or a camera frame is displayed instead of a color frame or an alpha frame.

If the display processor did not use two sets of buffers, the display processor could provide a color frame as the data for the output when an alpha frame or a camera frame is expected, provide an alpha frame as the data for the output when a color frame or camera frame is expected, or provide a camera frame as the data for the output when a color frame or an alpha frame is expected. Given the very different content of alpha frames, color frames, and camera frames, the display of an alpha frame rather than an intended color frame or camera frame can appear as bright flashes to the user.

In one or more implementations, the digital overlay manager displaying emitted light images desires to display, as the emitted light images, an object moving across the display screen. For moving images, the color and transparency mask images can be sampled at different times, closer to their times of display. Thus, the object is rendered at its location at the time the color frame is displayed and the alpha frame is rendered at its location at the time the alpha frame is displayed. This results in the transparency mask image of an object displayed in an alpha frame being at a different location than the object in either the previous or subsequent color frame. For synthetic graphics, this may involve rendering the emitted light image one sub-frame in time later than the transparency mask image which preceded it. For captured video content, alternate frames can be used to produce the emitted light frame and the transparency frame. Alternatively, intermediate frames could be produced using optical flow and other algorithms, to effectively interpolate the frame time.

Sampling the color frames and the alpha frames closer to their times of display resolves banding artifacts on the leading and trailing edges of the object that can occur when color frames and alpha frames are synchronized to each other. This is because generally the color frame adds light where the object is displayed on the display screen and the transparency mask image blocks out the background view where the object is on the display screen. A user tracking the moving object anticipates the rate at which the object is moving and the user's eyes have moved along the anticipated trajectory of the object, so the transparency mask image ends up blocking out an area not exactly where the user is looking, which results in the leading edge of the object looking too bright and the trailing edge of the object looking too dark.

In one or more implementations, a desired portion of the emitted light image can be made to appear brighter to the user than the background view by setting the pixels for the desired portion to white in the color frame and setting corresponding pixels in the transparency mask image to be more transparent rather than opaque. By making the corresponding pixels in the transparency mask image more transparent, additional light is let through from the background view at those corresponding pixels, making the emitted light image displayed at the desired portion appear to the user to be slightly brighter. The desired portion appears slightly brighter than the background view despite the light falling at the desired portion falling on a diffuser between the background view and the user's eyes.

In one or more implementations, care is taken to synchronize changing the pixel value of the display screen with changing the state of the diffuser element. Maintaining this synchronization reduces or eliminates various artifacts, such as loss of contrast, that can result due to pixel values of the display screen being changed sequentially (like a rolling shutter) while the state of the diffuser element is changed in parallel (like a global shutter).

Various different techniques can be used to resolve these artifacts resulting from the difference in the manner in which changes are made in the display screen and the diffuser element. One technique is to synchronize the ambient light source to be on for less than a frame time. Another technique is to use a segmented diffuser element that is able to have some portions in the scatter state while other portions are in the transparent state. For example, such a segmented diffuser element can be locally controllable on a pixel-by-pixel basis where individual pixels (or groups of pixels) can be in a scatter state while other pixels are in a transparent state. Alternatively, a diffuser that is made of horizontal or vertical bands (aligned with the scan pattern of the LCD screen), can be synchronized to the LCD screen. Such bands may be several scanlines high, and as wide as the display, and may be more easily produced than a full dot matrix diffuser.

The techniques discussed herein thus include switching between two sets of video buffers. Each set of video buffers includes a color frame buffer and an alpha frame buffer, and optionally includes one or both of a camera frame buffer and a translucency frame buffer. The display content overlay system repeatedly sequences through different types of frames (e.g., alternately displaying a color frame and an alpha frame). If a frame drop occurs and the frame of a particular type is not ready, the display processor will not switch the set of buffers. This avoids tearing, as well as bright flashes from being displayed to the user as a result of a frame type other than the expected frame type being displayed.

In the following discussion, an example environment is described that may employ the techniques described herein. Example procedures are also described which may be performed in the example environment as well as other environments. Consequently, performance of the example procedures is not limited to the example environment and the example environment is not limited to performance of the example procedures.

Example Digital Content Overlay Environment and System

Example Display System

Figure 2:
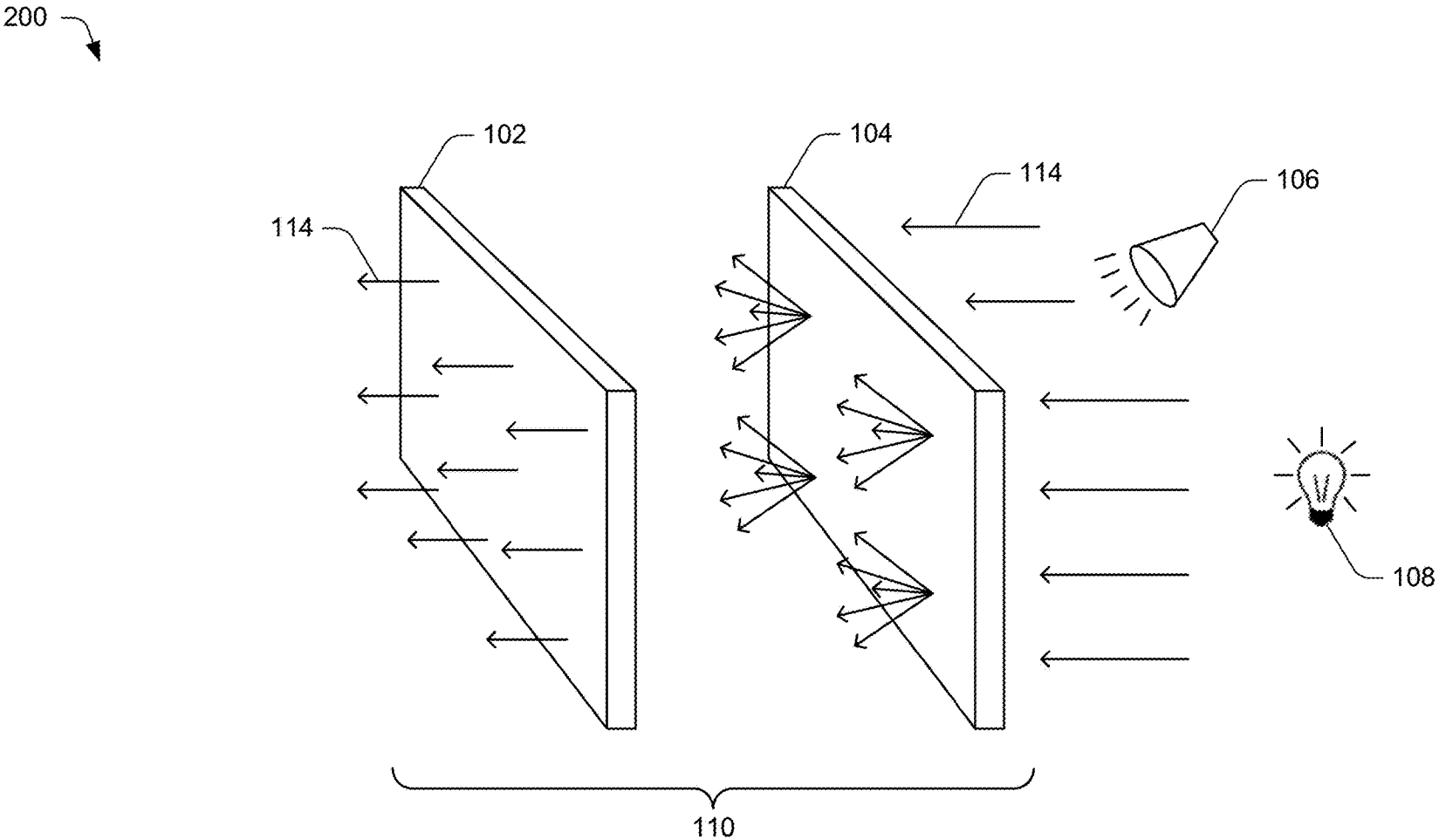
FIG. 2 illustrates an example environment with a display screen in an emissive state and a diffuser element in a scatter state.

FIGS. 1 and 2 illustrate a display screen 102, a diffuser element 104, a diffuser direct light source 106, and an ambient light source 108 in accordance with one or more implementations. The display screen 102 and the diffuser element 104 collectively are also referred to as the display system 110. Specifically, FIG. 1 illustrates an example environment 100 with the display screen 102 in a masking state and the diffuser element 104 in a transparent state (thus the display system 110 reveals the scene behind the diffuser element 104 while the display screen 102 is displaying a transparency mask image). The scene behind the diffuser element 104 is also referred to as a background scene or a background view. FIG. 2 illustrates an example environment 200 with the display screen 102 in an emissive state (displaying an emitted light image) and the diffuser element 104 in a scatter state.

As used herein, the term "display screen" (or sometimes simply "screen") refers to an electronic display or monitor. In particular, the term display screen includes an electronic display for presenting digital content. A display screen includes a monitor that is transparent (e.g., capable of transmitting all visible light wavelengths) and that is independent of, or separate from, a backlight. Moreover, a display screen can include filtering elements that can selectively modify light waves passing through the screen. For example, a display screen can include an LCD screen. More specifically, a display screen may refer to an LCD screen such as, for example, a twisted nematic ("TN") LCD, an in-plane switching ("IPS") LCD, a super in-plane switching ("S-IPS") LCD, an advanced fringe field switching ("AFFS") LCD, a vertical alignment ("VA") LCD, or a blue phase mode LCD. Although discussed herein as an LCD screen, it should be noted that the display screen can be other types of attenuating display screens. For example, the display screen can be a MEMS-based shutter display with flaps that open and close display screen.

As used herein, the term "diffuser element" (or "switchable diffuser" or sometimes simply "diffuser") refers to an object that selectively scatters or transmits (e.g., passes) light globally (e.g., as a single pixel), on a pixel-by-pixel basis, or in groups of pixels. In particular, a diffuser element includes an object that can alternate between a transparent state and a scatter state. More specifically, a diffuser element can include a sheet, screen, film, or layer of material that can alternate between a transparent state to pass light (e.g., such that it appears like glass) and a scatter state to scatter light (e.g., such that it appears like a mirror). For instance, the diffuser element can be composed of a material that, in response to electrical stimulation, transitions from translucent (i.e., scattering) to transparent or vice-versa. Additionally, the diffuser element can be composed of a material that can transition from translucent to transparent or vice-versa at a rate of up to 300 Hz or faster.

As used herein, a "scatter state" refers to a state of an object that scatters light. When an object scatters light, such as a milky liquid or frosted glass, the light passing through is deflected over a lobe of angles (i.e., making the object translucent). This has the effect of blurring objects seen through the scattering medium. Light shining onto a scattering medium can make it look like a bright white glowing object, whose color does not change based on the direction of view. This makes it suitable for use as a backlight for a display.

As used herein, "transparent" refers to a state of an object that passes all (nearly all) light (without blur or attenuation). "Semi-transparent" may refer to a state of an object that passes a subset of the visible light such that an observer can perceive some light passing through the object (e.g., a change in brightness while not blurring the view of objects seen through it). Accordingly, an object in a semi-transparent state passes less light than the same object in a transparent state. "Opaque" refers to a state of an object that blocks (all or nearly all) visible light (e.g., such that an observer cannot perceive an image through the object).

The transparency of an object may depend on the wavelength of the light, attenuating some colors more than others. Red tinted glass, for instance, allows through red light while blocking other colors. A liquid crystal display controls the transparency of pixels for red, green and blue bands of light, using adjacent regions with red, green and blur filters respectively. The digital content overlay system allows pixels to be displayed that have controllable emissive (or added) light, along with controlled transparency. Both the emitted color, and the transparency are controllable at each pixel for R, G, and B independently, or for other color bands for displays based on different color filters.

As used herein, the term "emitted light image" refers to a visible portrayal of digital content items generated by a display screen filtering light in an emissive state. An emitted light image can include digital content items that are generated by filtering light emitted from a diffuser direct light source. In some implementations, the diffuser direct light source projects or emits a white light. Thus, an emitted light image can include a digital content item of any color that results in filtering select wavelengths (or no wavelengths) from the while light that passes through the display screen. A sequence of emitted light images is referred to herein as video or video content, and can include, for example, synthetic graphics or captured video content (a sequence of images captured by an image capture device). A corresponding set of transparency mask images could be derived from the video sequence using advanced masking algorithms or green-screen technologies.

As shown in FIG. 1, the example environment 100 includes a diffuser direct light source 106 and an ambient light source 108. As used herein, the term "diffuser direct light source" refers to a light source that a display screen utilizes to display an emitted light image. In particular, a diffuser direct light source includes a light source located behind a display screen. A diffuser direct light source can refer to a directional light that shines onto a diffuser element and that is unobstructed by other objects (e.g., objects within a display case). As an alternative, the diffuser direct light source may refer to a sheet of material that is controllably emissive. The digital content overlay system in these implementations could use a diffuser direct light source in the form of a uniform backlight that is mostly transparent, but coated or containing a light emitting material, such as an organic light emitting diode, to illuminate a display screen directly. For example, the diffuser direct light source could be a transparent backlight made of material that fluoresces when suitably illuminated externally or that glows when edge-lit. An alternative design is to combine the diffuser direct light source with a diffuser (e.g., the diffuser element 104), with the light source used to illuminate the diffuser directly. When illuminated in this way, and in a scattering state, the diffuser may act as a backlight for the transmissive display. Using a diffuser direct light source to illuminate a diffuser can help to ensure a wide angle of spread of light before the light reaches the display, enabling a wide viewing angle for any emissive function of the display.

As also used herein, the term "ambient light source" refers to a light source projecting light behind the diffuser element 104. For example, the term ambient light source includes a light source projecting light to an internal cavity of a display case housing behind the diffuser element 104. Behind the diffuser element 104 refers to the opposite side of the diffuser element 104 as the display screen 102. For example, an ambient light source may include a light source that produces and provides light from behind the diffuser element 104 and that projects light in a direction toward the display screen 102 either directly or after reflecting off objects in the display case.

As illustrated in FIG. 1, the digital content overlay system sets the ambient light source 108 in an on state to illuminate the objects behind the display screen 102 seen through the diffuser element 104. In particular, in one or more implementations the digital content overlay system sets the ambient light source 108 in an on state with the diffuser direct light source 106 set in an off state. Additionally or alternatively, the digital content overlay system sets the ambient light source 108 in a flash on state. In the flash on state, the ambient light source 108 is off while the scan-lines are being drawn on the display screen 102, and flashed on briefly after the last scan line.

As shown, the light 112 from behind the diffuser element 104 (indicated by the arrows of FIG. 1 that represent light waves), emanates in a direction out from the ambient light source 108, through the diffuser element 104, and through the display screen 102. As also shown, some of the light 112 is selectively attenuated by the display screen 102 (as shown by the decrease in length of the arrows after passing through the display screen 102) to display a background view modulated by a transparency mask image. In some implementations, however, the display screen 102 does not filter any light 112 in the masking state. For an LCD screen, however, at least half of the light 112 is typically blocked by the various layers of the LCD screen, even in a state of maximum transparency. To overcome this loss of brightness for tangible objects within a display case, the digital content overlay system may brighten the ambient light 108.

As illustrated in FIG. 1, the digital content overlay system sets the display screen 102 in a masking state and sets the diffuser element 104 in a transparent state. Therefore, the diffuser element 104 does not scatter the light 112 as it passes through the diffuser element 104, and the display screen 102 selectively attenuates the light 112. Accordingly, much of the light 112 passes through the diffuser element 104 and the display screen 102 to reveal an image of the scene behind the diffuser element 104.

FIG. 2, as mentioned above, illustrates an environment 200 including the display screen 102, the diffuser element 104, the diffuser direct light source 106, and the ambient light source 108. In particular, FIG. 2 illustrates the display screen 102 in an emissive state, the diffuser element 104 in a scatter state, a diffuser direct light source 106 in an on state, and the ambient light source 108 in an off state. The digital content overlay system sets the ambient light source 108 to the off state and does not project any light outward toward the diffuser element 104. Even so, as shown in FIG. 2, the diffuser element 104 blocks (e.g., scatters) the light 112 that emanates from behind the diffuser element 104. Thus, the diffuser element 104 obstructs an image of the scene behind the diffuser element 104 from projecting through the display screen 102 and being visible to an observer. Additionally or alternatively, the digital content overlay system sets the ambient light source 108 in a flash on state.

In addition, the digital content overlay system sets the diffuser direct light source 106 to an on state to produce or emit the light 114 (illustrated by the arrows in FIG. 2). The light 114 from the diffuser direct light source 106 projects outward toward the diffuser element 104. In particular, the light 114 projects from the diffuser direct light source 106 to illuminate the diffuser element 104 in the scatter state. Indeed, the diffuser element 104 scatters the light 114 that is projected onto it from behind, thereby blurring any image that would otherwise be visible through the diffuser element 104 in the transparent state and producing an even glow of light (e.g., white light) across the diffuser element 104. As a result, by scattering the light 114 in this way, the diffuser element 104 provides an emitted light for the display screen 102 to produce an emitted light image. As shown, the diffuser element 104 scatters the light 114 to produce cones of rays that project toward the display screen 102. Thus, the diffuser element 104 acts as a backlight for the display screen 102 when in the scatter state.

As mentioned, the diffuser direct light source 106 provides light 114 evenly across the diffuser element 104 to provide a uniform picture to an observer looking at the display screen backlit by the diffuser element 104. Additionally, in some implementations the diffuser direct light source 106 provides a white light that includes all wavelengths of visible light. In FIG. 2, the digital content overlay system sets the display screen 102 in the emissive state and filters some of the light 114 projected by the diffuser direct light source 106 onto the diffuser element 104. For example, the display screen 102 attenuates select wavelengths from the light 114 to display digital content (e.g., the emitted light image).

Different areas of the display screen 102 can filter different wavelengths of the light 114 to display different colors as part of an image, icon, text, etc. Similarly, some areas of the display screen 102 may not filter any wavelengths of the light 114, but may instead pass the light 114 through the display screen 102 to display all wavelengths produced by the diffuser direct light source 106 illuminating the diffuser element 104 (e.g., to show the color white). As illustrated in FIG. 2, the display screen 102 filters the light 114 (e.g., to display at least part of a digital overlay as shown by the emitted light image).

Although FIGS. 1 and 2 illustrate a particular arrangement of the display screen 102, the diffuser element 104, the diffuser direct light source 106, and the ambient light source 108, additional arrangements are possible. For example, in some implementations the diffuser direct light source may be a transparent material with a controllable glow such as a transparent organic light emitting diode ("OLED") or grid of OLEDs. In these implementations, the diffuser direct light source may have the same height and width as the diffuser element 104 and may be located directly behind and/or affixed to the diffuser element 104. By way of another example, the diffuser element 104 can be segmented by region reference object down to the pixel level.

Although FIGS. 1 and 2 illustrate the diffuser direct light source 106 as separate from the diffuser element 104, in some implementations the diffuser element 104 may include the diffuser direct light source 106. For instance, the diffuser element 104 may include a light source on one face (e.g., a face that is in a direction toward the ambient light source 108) and a switchable diffuser on an opposite face (e.g., a face that is in a direction toward the display screen 102). Accordingly, the diffuser element 104 may be capable of alternating between a transparent state wherein the diffuser element 104 passes light (while the diffuser direct light source is off), and a scatter state wherein the diffuser element 104 scatters light from behind the diffuser element 104 and also emits light outward toward the display screen 102.

In addition, although FIGS. 1 and 2 are described as implementations where the ambient light source 108 alternates between an on state (e.g., FIG. 1) and an off state (e.g., FIG. 2), or is in a flash on state, in some implementations the digital content overlay system maintains the ambient light source 108 in an on state to project light. In these implementations, the diffuser element 104 scatters the light from the ambient light source 108 when the diffuser element 104 is translucent in the scatter state. In addition, the diffuser element 104 passes the light from the ambient light source 108 when the diffuser element 104 is transparent.

As mentioned above, in one or more implementations the digital content overlay system synchronizes these components (the display screen 102, the diffuser element 104, the diffuser direct light source 106, and the ambient light source 108) and toggles states of the components based on a display rate. In particular, the digital content overlay system can toggle component states at a frequency that is faster than the human eye can perceive. Accordingly, the digital content overlay system can display contents behind the diffuser element 104 together with a digital overlay.

Figure 3:
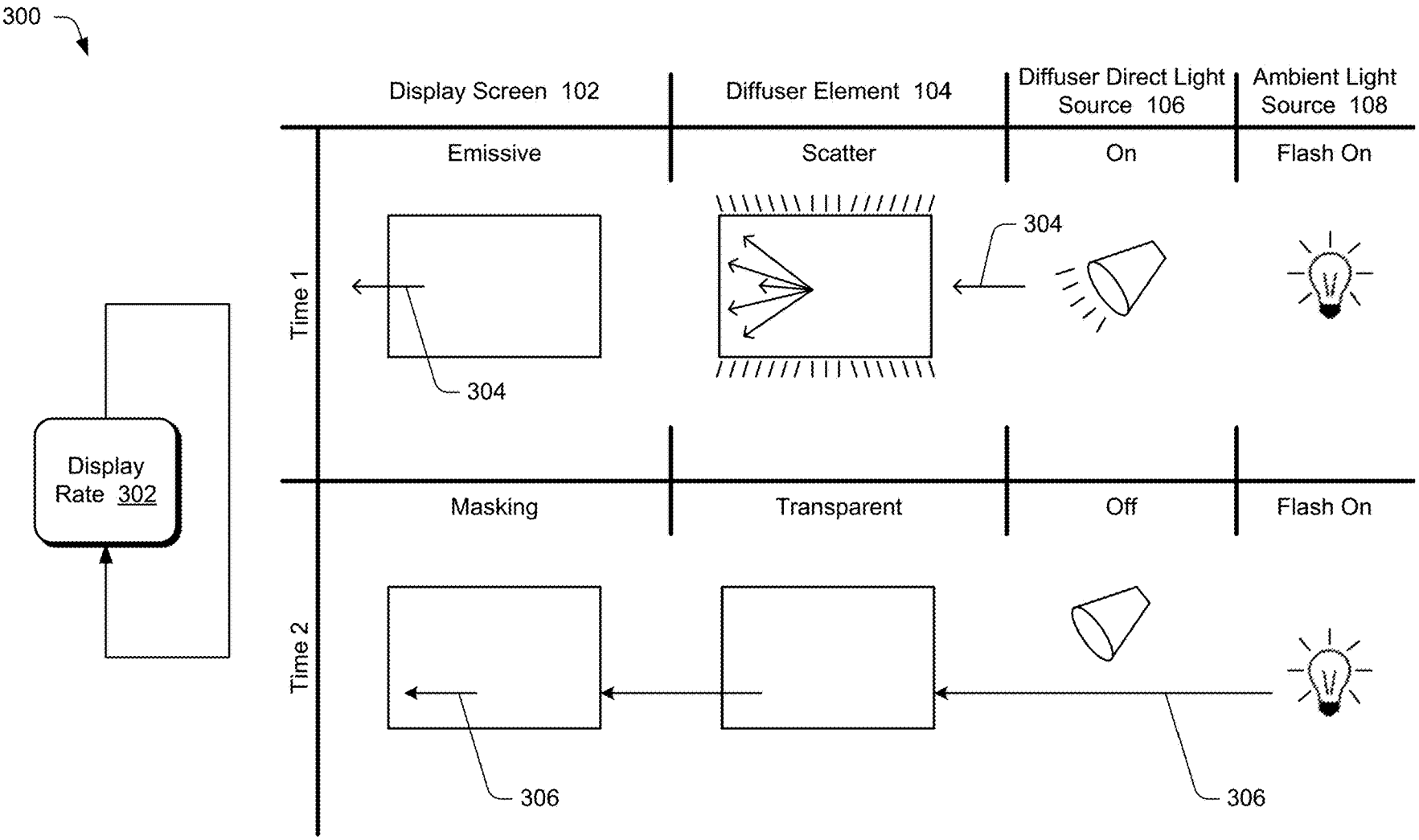
FIG. 3 illustrates an example flow depicting the respective states of a display screen, a diffuser element, a diffuser direct light source, and an ambient light source.

To describe the toggling of states between a first point in time wherein the digital overlay is visible and a second point in time wherein the scene behind the diffuser element 104 is visible, FIG. 3 illustrates an example flow 300 with "Time 1" and "Time 2" depicting the respective states of the display screen 102, the diffuser element 104, the diffuser direct light source 106, and the ambient light source 108.

As used herein, the term "display rate" refers to a rate or frequency of changing a display screen (or pixels of a display screen) and/or a diffuser element. In particular, the term display rate includes a rate or frequency of alternating a display screen between a masking state and an emissive state (or vice-versa). The display rate may be expressed in Hertz ("Hz"). In some implementations, the display rate is limited by a refresh rate associated with the display screen 102. A refresh rate is generally defined as a rate at which a display can redraw every pixel on the display. Some display screens have a refresh rate of 144 Hz, while other display screens have a refresh rate of 120 Hz, 72 Hz, 60 Hz, or 30 Hz. However, in other implementations, the display rate may include a frequency higher than 144 Hz (e.g., 240 Hz or even up to 300 Hz). At 144 Hz, the display screen 102 can perform up to 144 transitions per second. Thus, in these implementations the display screen 102 can display up to 72 emitted light images (frames) per second as well as 72 transparency mask image modulated background views (frames) in the same second. In one or more implementations, the display rate is fast enough (e.g., above 60 Hz) such that, when the display screen 102 is observed by the naked eye, the transitions between the emissive state and the masking state are imperceptible and the view (e.g., the digital overlay that is a combination of the transparency mask image and the emitted light image) of the display screen appears constant.

In particular, the flow 300 includes a display rate clock 302 which toggles the components (e.g., the display screen 102, the diffuser direct light source 106, the diffuser 104, and the ambient light source 108) between their respective states at Time 1 and Time 2. As illustrated in FIG. 3, the display rate clock 302 repeats the toggling between Time 1 and Time 2 at a rate dictated by a refresh rate of the display screen element 102. For example, the display rate clock 302 may toggle between the states at Time 1 and Time 2 at a rate of up to 144 Hz. In the same or other implementations, the display rate clock 302 toggles between Time 1 and Time 2 at a rate of more or less than 144 Hz (e.g. 300 Hz, 240 Hz, 120 Hz, 60 Hz, 30 Hz, etc.). Furthermore, the display rate clock 302 may toggle between Time 1 and Time 2 at a rate within a particular range (e.g., from 30 to 60 Hz, from 60 to 144 Hz, from 144 to 300 Hz, etc.). Thus, as described above, each of the components are in their respective states corresponding to Time 1 up to 150 times per second, and are likewise in their respective Time 2 states up to 150 times per second. Although particular, rates are described, additional (e.g., faster or slower) rates are possible.

As illustrated in FIG. 3, at Time 1 the digital content overlay system sets the display screen 102 to an emissive state, the diffuser element 104 to a scatter state, the diffuser direct light source 106 to an on state, and the ambient light source 108 to a flash on state. In the flash on state, the ambient light source 108 is off while the scan-lines are being drawn on the display screen 102, and flashed on briefly after the last scan line. Then the ambient light source 108 is off again while the next frame is drawn.

The diffuser direct light source 106 projects light toward the diffuser element 104. For example, the diffuser direct light source 106 projects a light wave 304 toward the diffuser element 104. Because the diffuser element 104 is in the scatter state, the diffuser element 104 scatters the light wave 304 to produce a cone of light rays, and the diffuser element 104 glows evenly to emit light for the display screen 102. Thus, the display screen 102 filters the light 304 that passes through it to display an emitted light image.

FIG. 3 also illustrates the states of the components at Time 2, where the digital content overlay system sets the display screen 102 to a masking state, the diffuser element 104 to a transparent state, the diffuser direct light source 106 to an off state, and the ambient light source 108 to a flash on state. In the flash on state, the ambient light source 108 is off while the scan-lines are being drawn on the display screen 102, and flashed on briefly after the last scan line. Then the ambient light source 108 is off again while the next frame is drawn.

As shown in FIG. 3, the ambient light source 108 projects a light wave 306 outward through the transparent diffuser element 104 and the display screen 102 (which may selectively attenuate light to display a transparency mask image). Indeed, as shown in FIG. 3, the arrow representing light wave 306 is shorter when exiting the display screen to represent the attenuation of the light that passes through the display screen 102. Accordingly, an observer may perceive the light wave 306 (together with other light waves) to see the scene behind the diffuser element 104 in addition to a transparency mask image.

As mentioned above, the digital content overlay system synchronizes these components (the display screen 102, the diffuser element 104, the diffuser direct light source 106, and the ambient light source 108) and toggles the components between states at Time 1 and Time 2. The digital content overlay system performs the toggling function according to the display rate (as illustrated by the display rate clock 302) described above. Thus, the digital content overlay system can present a digital overlay associated with the emitted light image and an object view modulated by the transparency mask image at Time 2 that appear together as a composite image to the human eye.

While FIG. 3 illustrates toggling between component states at an even ratio (e.g., equal amounts of time between an emissive state and a masking state) based on a display rate, in some implementations the digital content overlay system toggles between component states at a different ratio. Indeed, the ratio or fraction of time for which the display screen (and other components) is in each respective state controls the overall brightness of each of the emitted light image and the transparency mask image within the composite image.

For example, the digital content overlay system may change the ratio between the states at Time 1 and the states at Time 2 to something other than a one-to-one correspondence. In particular, Time 1 may represent a number of consecutive frames (e.g., display rate cycles) that the digital content overlay system maintains the state of each component at its respective state at Time 1. For instance, the digital content overlay system may maintain the Time 1 states for two, three, four, etc. consecutive display rate cycles without toggling to the Time 2 states. Likewise, Time 2 may represent a number of consecutive frames that the digital content overlay system maintains the state of each component at its respective state at Time 2. For example, the digital content overlay system may maintain the Time 2 states for two, three, four, etc., consecutive display rate cycles.

In this manner, the digital content overlay system can vary the ratio (e.g., duty cycle) between component states. To illustrate a 2:3 ratio, the digital content overlay system may maintain the Time 1 states for two consecutive frames based on the display rate, then the digital content overlay system can toggle the components to the Time 2 states and maintain the Time 2 states for three consecutive frames based on the display rate. In addition to the 2:3 ratio in the foregoing example, the digital content overlay system can utilize a 1:2 ratio, a 3:5 ratio, a 4:5 ratio, or vice versa (e.g., 3:2, 2:1, 5:3, or 5:4).

Additional information describing the digital content overlay system can be found in U.S. Pat. No. 10,181,299 to Miller et al., which is hereby incorporated by reference herein in its entirety.

It should be noted that although the display system 110 is discussed herein as displaying emitted light images and the background view, the display system 110 optionally supports inputs via contact and/or non-contact sensors. For example, a touchscreen layer can be situated between the display screen 102 and the user, a non-contact sensor such as a sensor or controller available from Leap Motion of San Francisco, Calif. can receive user inputs, and so forth. This would allow, for example, a numeric keyboard to be displayed as the emitted light image. User inputs can be received and provided to the program displaying the emitted light image, and then the numeric keyboard can be dismissed (e.g., the program ceases displaying the numeric keyboard emitted light image).

Quad Buffering

Figure 4:
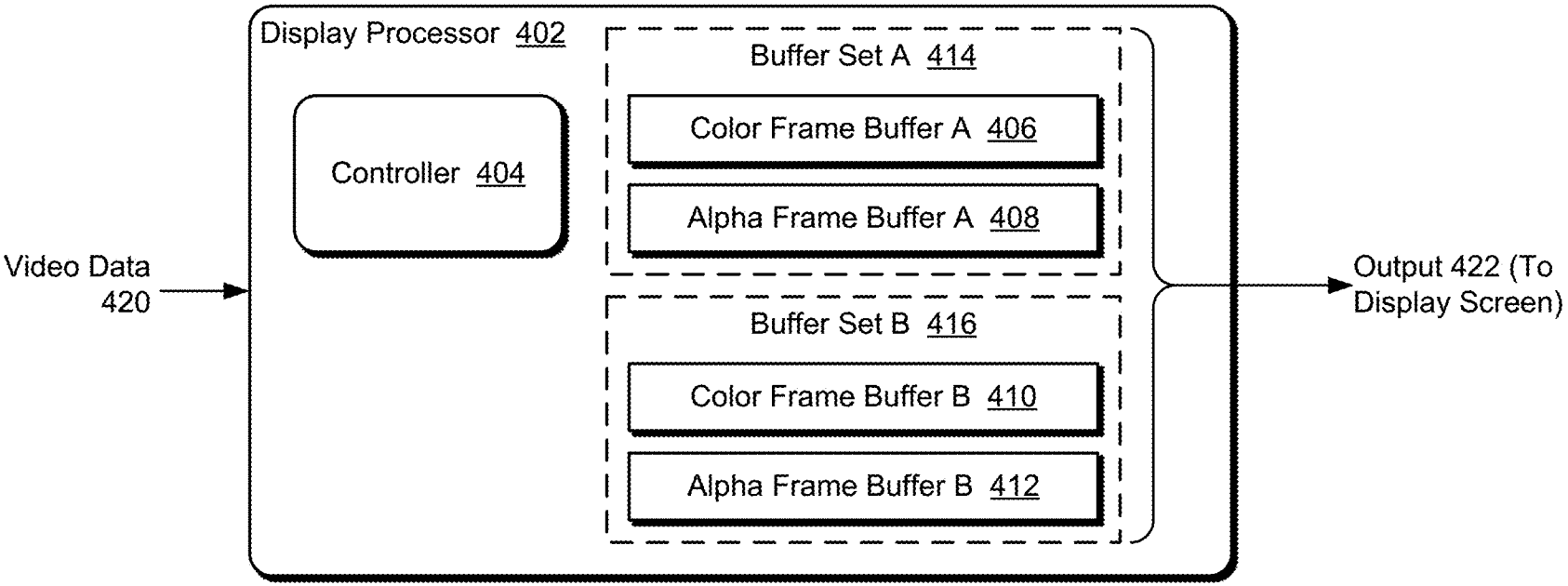
FIG. 4 illustrates an example display processor using four video buffers to generate the display on a display screen.

FIG. 4 illustrates an example display processor 402 that implements some of the techniques discussed herein. In particular, the display processor 402 implements quad buffering of data for the display screen 102. As used herein, the term "quad buffering" refers to the use of four video buffers to display the content on the display screen 102. The display processor includes a controller 404, a color frame buffer A 406, an alpha frame buffer A 408, a color frame buffer B 410, and an alpha frame buffer B 412. Video data 420 is received by the display processor 402 from a digital overlay manager that generates, plays back, or otherwise provides the emitted light image. The video data 420 includes data for both the color frames and the alpha frames. The controller 404 coordinates the operation of the display processor 402, including switching between which buffer 406, 408, 410, and 412 is to provide data as the output 422 to the display screen (e.g., display screen 102). The display processor 402 can be implemented as a standalone component (e.g., a graphics processing unit (GPU)), or as part of another component (e.g., a central processing unit (CPU)).

As discussed above, the digital content overlay system generates a digital overlay utilizing the switchable diffuser element 104 and the display screen 102 by rapidly alternating between an emitted light image and a background view of objects attenuated by a transparency mask image. The display processor 402 supports use of both color frames and alpha frames to implement the display system 110.

A used herein, the term "color frame" refers to data describing one frame of video that is to be displayed on a display screen. This data is, for example, the pixel values for one frame of video, informing the display screen what values to set the pixels of the display screen while in its emissive state at in order to display the desired emitted light image. The color frame can include data describing, for example, synthetic images or captured video content.

As used herein, the term "alpha frame" refers to data describing one frame of video that is to be displayed as a transparency mask image that corresponds to a color frame. To facilitate making the emitted light image opaque, the alpha frame has a transparency mask image that is the same shape and at approximately the same location on the display screen 102 as the image, icon, text, etc. that is displayed for the emitted light image. In situations where the emitted light image is moving quickly, the location on the display screen 102 where the transparency mask image is displayed may be shifted slightly (based on the speed at which the emitted light image is moving) from the location on the display screen 102 where the emitted light image is displayed, as discussed in more detail below.

Color frames are provided to the display screen 102 while the display screen 102 is in the emissive state, allowing the emitted light image to be displayed and visible to a user. Alpha frames are provided to the display screen 102 while the display screen is in the masking state, filtering the light from behind the diffuser element 104 to display the transparency mask image. By having a transparency mask image that is the same shape and at approximately the same location as the image, icon, text, etc. that is displayed for the emitted light image, light from the ambient light source 108 that passes through the diffuser element 104 is at least partially blocked by the display screen 102 at the locations where the transparency mask image is being displayed on the display screen 102. Thus, less light comes through at the locations where the transparency mask image is located on the display screen 102, preventing the scene from behind the diffuser element 104 from bleeding through the emitted light image, resulting in a composite image that is opaque.

In the alpha frame, locations in the frame that are not part of the transparency mask image are white, and locations in the frame that are part of the transparency mask image are a value between white and black depending on the transparency or opaqueness desired for the composite image. If the composite image is desired to be opaque then the locations in the alpha frame that are part of the transparency mask image are black. Locations along the edge of the transparency mask image are optionally grey. If the composite image is desired to be transparent then the locations in the alpha frame that are part of the transparency mask image are values between white and black, with values closer to black indicating less transparency of the composite image and values closer to white indicating more transparency of the composite image.

Figure 5:
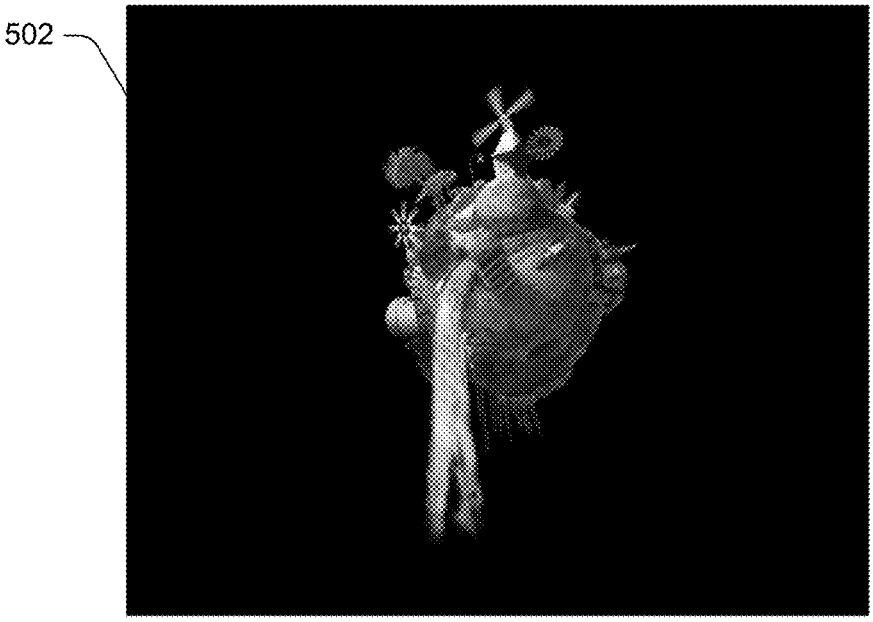
FIG. 5 illustrates an example color frame.

An example of the color frames, alpha frames, and their display are illustrated in FIGS. 5, 6, 7, and 8. FIG. 5 illustrates an example color frame 502. As illustrated, the emitted light image is a floating globe with various buildings, trees, and a waterfall.

Figure 6:
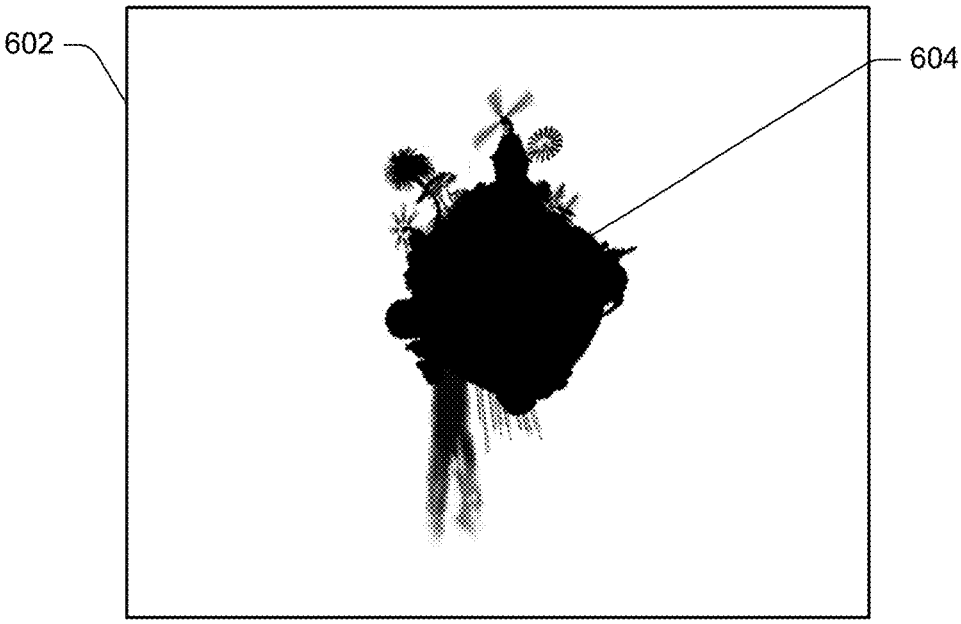
FIG. 6 illustrates an example alpha frame.

FIG. 6 illustrates an example alpha frame 602. As illustrated, the transparency mask image 604 has the same shape and is at approximately the same location as the emitted light image in color frame 502.

Figure 7:
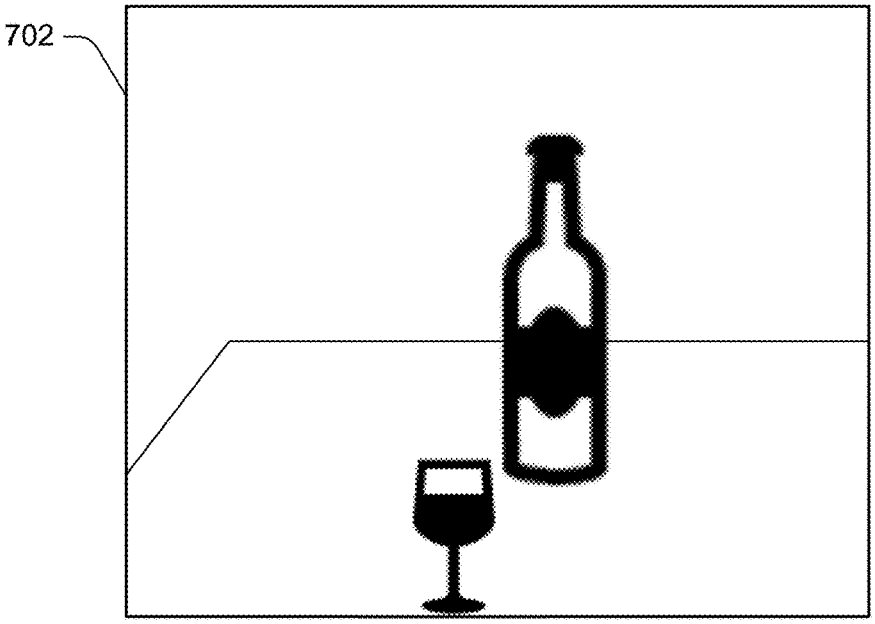
FIG. 7 illustrates an example background view.

FIG. 7 illustrates an example background view 702. The background view is a view of the scene behind the diffuser element 104 as discussed above. The background view 702 includes a bottle and a glass of wine sitting on a table behind the diffuser element 104.

Figure 8:
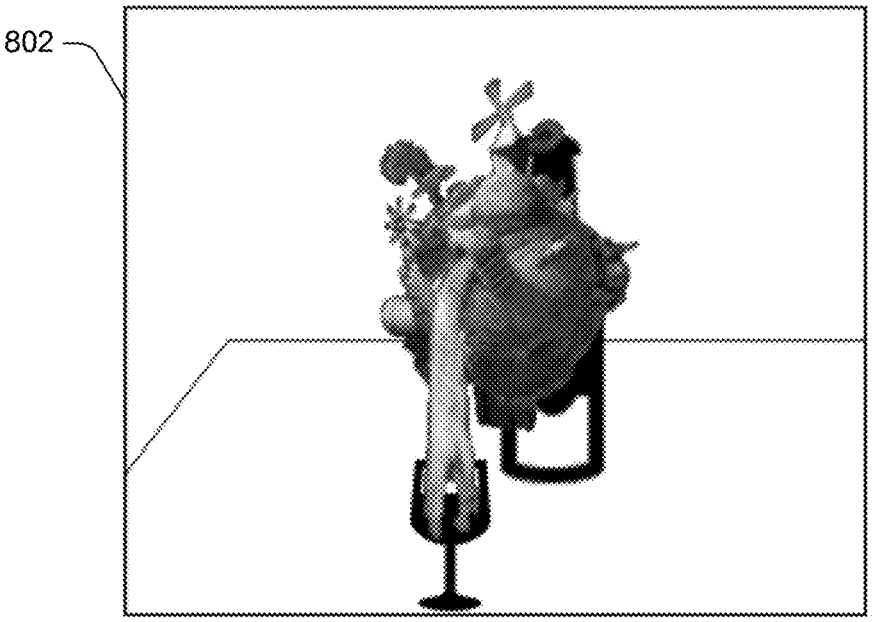
FIG. 8 illustrates an example view seen by a user of a display content overlay system.

FIG. 8 illustrates an example view 802 seen by a user of the display content overlay system. The emitted light image from the color frame 502 is seen as overlaying the background view 702. The composite image resulting from the color frame 502 and the alpha frame 602 is opaque, and the background view 702 is visible in areas where the floating globe in the color frame 502 and the transparency mask image in the alpha frame 602 are not present. It is to be appreciated that the view 802 is at a particular point in time and displays a single color frame 502. Over time, the view will change as the emitted light image and transparency mask image are changed.

Returning to FIG. 4, the frame buffers 406-412 are organized into two sets: buffer set A 414 and buffer set B 416. The controller 404 alternately has a color frame buffer and an alpha frame buffer provide data as the output 422. For example, the controller 404 has a color frame buffer provide data as the output 422, followed by an alpha frame providing data as the output 422, followed by a color frame providing data as the output 422, followed by an alpha frame providing data as the output 422, and so forth. This alternating occurs based on the display refresh rate.

With two sets of buffers 414, 416, one set of buffers is used to provide data as the output 422 while the other set of buffers is having new video data 420 written into them. At some point, typically at every other vertical sync (Vsync), the controller 404 switches which set of buffers is providing data as the output 422 and which set of buffers is having new video data 420 written into them.

Figure 9:
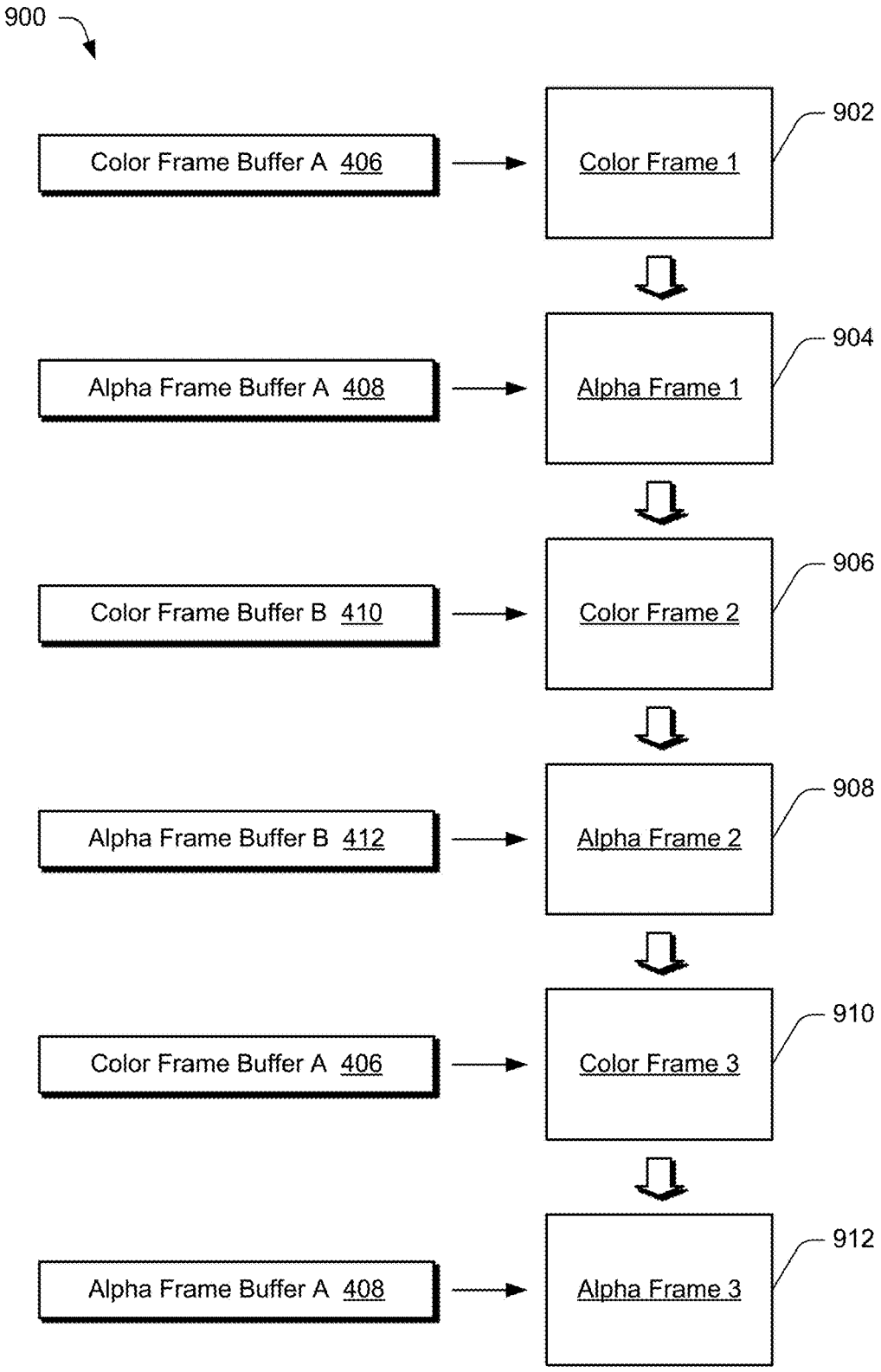
FIG. 9 illustrates an example of a sequence of frames displayed as video data.

FIG. 9 illustrates an example 900 of a sequence of frames displayed as the video data 420. In the example 900, a color frame 902 is displayed, followed by an alpha frame 904, followed by a color frame 906, followed by an alpha frame 908, followed by a color frame 910, followed by an alpha frame 912. The data for the color frame 902 and the alpha frame 904 are provided by the color frame buffer 406 and the alpha frame buffer 408, respectively. The controller 404 then switches to the other set of buffers, so the data for the color frame 906 and the alpha frame 908 are provided by the color frame buffer 410 and the alpha frame buffer 412, respectively. The controller 404 then switches to the other set of buffers, so the data for the color frame 910 and the alpha frame 912 are provided by the color frame buffer 406 and the alpha frame buffer 408, respectively.

Returning to FIG. 4, situations can occur where there is a frame drop. A frame drop refers to the situation where a color frame or an alpha frame is not ready for display despite it being time for a switch of the set of buffers. A frame can be dropped for any of a variety of different reasons, such as rendering complexity for emitted light image, video decoding, file reading, physical disturbance of the AR display, and so forth. By switching the alpha and color frame buffers in sets, a pair of color frame buffer and alpha frame buffer are always the current set of buffers to provide data as the output 422. If a frame drop occurs and the next color frame or alpha frame is not ready, the controller 404 will not switch the set of buffers. This avoids tearing caused by displaying data from two different frames in a single drawing of the display screen 102. This also results in the current color frame and the current alpha frame being displayed again, and then switching the set of buffers. The display processor 402 thus avoids the situation where an alpha frame is displayed instead of a color frame, or a color frame is displayed instead of an alpha frame.

By way of example, if the color frame 910 were not ready for display at the needed time, then the switch from buffers 410 and 412 to buffers 406 and 408 would not occur until the next Vsync. Rather, the display of color frame 906 and alpha frame 908 would be repeated.

If the display processor 402 did not use two sets of buffers, the display processor 402 could provide a color frame as the data for the output 422 when an alpha frame is expected, or provide an alpha frame as the data for the output 422 when a color frame is expected. For example, if the display processor 402 had only a single set of buffers 414, then if an alpha frame is being displayed and a frame drop occurs so that the next color frame is not ready, the controller 404 would not switch to the color frame buffer 406. This would result in the current alpha frame in the alpha frame buffer 408 being displayed again, even though a color frame is expected to be displayed. Accordingly, the display screen 102 would be in the emissive state and the diffuser element 104 would be in the scatter state. This can result in what appear to be bright flashes to the viewer. Displaying color frames instead of alpha frames, or alpha frames instead of color frames can cause significant flashes. These noticeable flashes occur because a given region of the image may have a very different appearance in the alpha frame and the color frame. Since the alpha frame encodes the transparency of a region directly in a color value, a purely transparent region will have an emissive color of black and a transparency color of white. Double showing a transparency mask image will cause that region of the display to flash brightly. Double showing a color image will cause that region of the display to darken excessively. For an opaque white region of the display, the converse applies. Double-showing the color image will cause that region of the display to flash brightly, while double showing the transparency mask image will cause that region of the screen to flash darker.

The quad buffer configuration of display processor 402 can optionally be implemented based on commodity hardware providing stereo quad buffering. Stereo quad buffering refers to using one set of buffers for the left side of a stereo display and another set of buffers for the right side of the display. The color frame buffer 406 and the alpha frame buffer 408 can be mapped to the left stereo buffers, and the color frame buffer 410 and the alpha frame buffer 412 can be mapped to the right stereo buffers. Thus, an existing display processor 402 implementing stereo quad buffering can be used to implement the quad buffering of FIG. 4. Such an existing display processor 402 is expected to support mandatory alternations between the left and right eyes, even when the back buffer (the buffer having new video data 420 written into it) is not ready for swapping.

In one or more implementations, the display processor 402 also includes a first-in, first-out (FIFO) buffer and a small set of frames are pre-fetched into the FIFO. The number of frames that are pre-fetched can vary and is optionally user-configurable. The larger the FIFO, the more frames can be loaded to smooth out performance, at the expense of larger memory consumption. When a frame is transferred to a frame buffer 406, 408, 410, or 412, the frame is discarded from the front of the FIFO, and a future frame can be loaded into the back of the FIFO. The future frame can be loaded into the FIFO in various manners, such as using a dedicated thread for loading via a circular Pixel Buffer Object (PBO). Pre-fetching a small set of frames into the FIFO further smooths frame loading and display, reducing the number of dropped frames.

It should be noted that using the techniques discussed herein, the display screen 110 can be combined with any standard image and video readers/decoders. The techniques discussed herein thus support a variety of content that can be displayed as emitted light images without requiring any special or proprietary encoding or compression.

It should be noted that communicating both color frames and alpha frames from the display processor 402 to the display system 110 uses twice the pixel bandwidth of communicating just the color frames. Accordingly, a video connection supporting the larger bandwidth is used. For example, a display processor may be connected to the display system 110 using a DisplayPort connection.

It should also be noted that the digital content overlay system is switching the display screen 102 very rapidly between color frames and alpha frames. The color frame and alpha frame frames have very different content, so differences between sequentially displayed frames can be noticeable. Accordingly, a display screen 102 using fast responding LCD crystals is used in the display system 110 to provide an acceptable appearance to the user.

It should also be noted that intensity scaling may be used to reduce liquid crystal transition artifacts. This reduces the dynamic range of the emitted light image, such as by 20%, allowing the display screen 102 to tolerate the dramatic shifts in brightness between color frames and alpha frames. This further reduces burn-in in the display screen 102.

In one or more implementations, gamma correction for the display screen 102 is also performed. The use of gamma correction improves anti-aliasing of the emitted light image.

It should further be noted that the data in the color frames and the alpha frames is very different. Accordingly, if the color frames and alpha frames are compressed, different compression algorithms are typically used. For example, the compression algorithm for color frames can be selected based on the frames typically containing color, while the compression algorithm for alpha frames can be selected based on the frames typically containing large portions of constant color. Similarly, different codecs can be used for the color frames and alpha frames.

Oct Buffering

Figure 10:
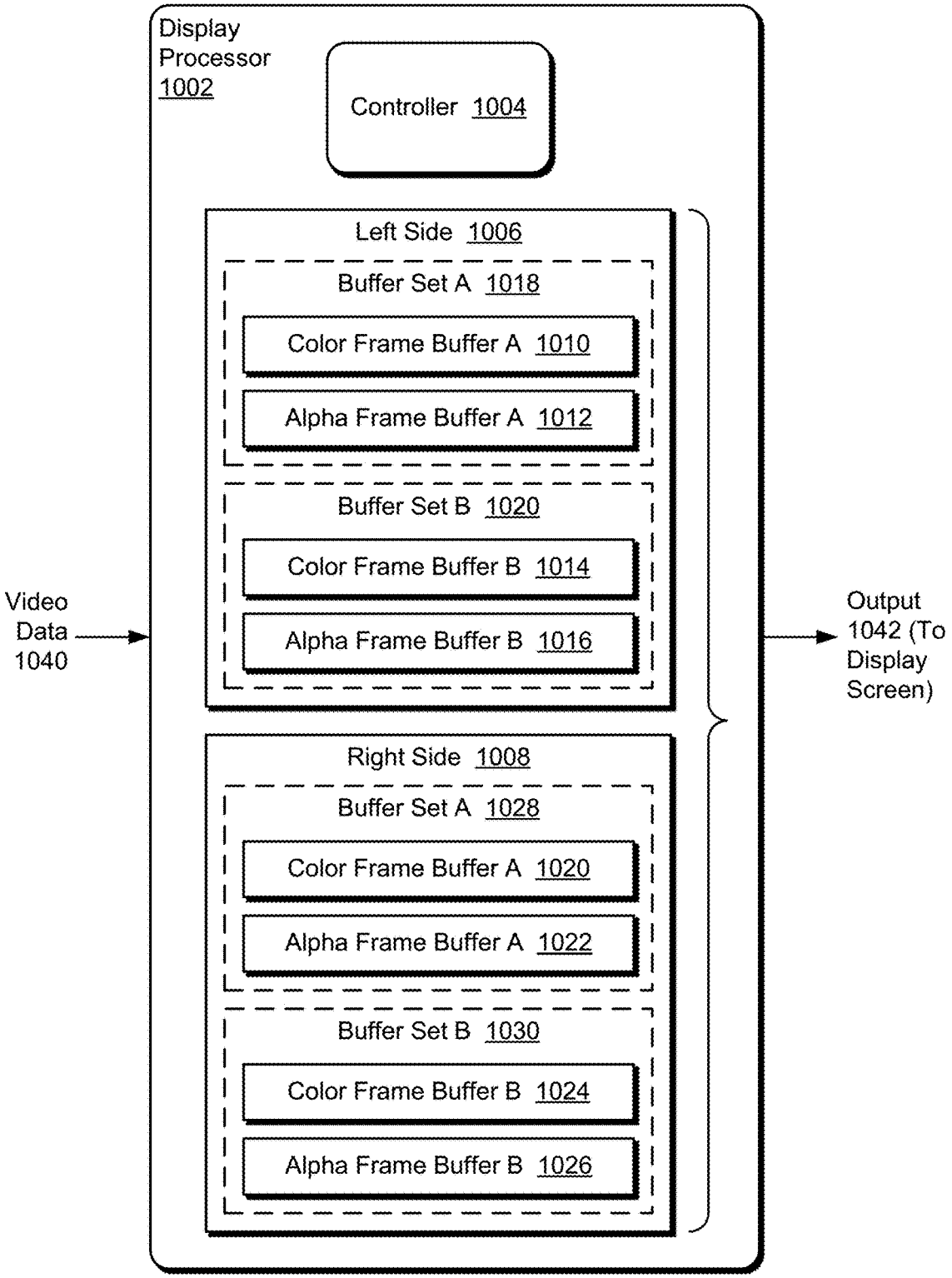
FIG. 10 illustrates an example display processor using eight video buffers to generate the display on a display screen.

FIG. 10 illustrates an example display processor 1002 that implements some of the techniques discussed herein. In particular, the display processor 1002 implements Oct buffering of data for the display screen 102. As used herein, the term "Oct buffering" refers to the use of eight video buffers to display the content on the display screen 102. The display processor includes a controller 1004, a left side collection of buffers 1006 and a right side collection of buffers 1008. The left side collection of buffers 1006 includes a color frame buffer A 1010, an alpha frame buffer A 1012, a color frame buffer B 1014, and an alpha frame buffer B 1016. The buffers 1010-1016 are organized into two sets: buffer set A 1018 and buffer set B 1020, each buffer set 1018, 1020 including a color frame buffer and alpha frame buffer. The right side collection of buffers 1008 includes a color frame buffer A 1020, an alpha frame buffer A 1022, a color frame buffer B 1024, and an alpha frame buffer B 1026. The buffers 1020-1026 are organized into two sets: buffer set A 1028 and buffer set B 1030, each buffer set 1028, 1030 including a color frame buffer and alpha frame buffer.

Video data 1040 is received by the display processor 1002 from a digital overlay manager that generates, plays back, or otherwise provides the emitted light image. The video data 1040 includes, for both left eye displays and right eye displays, data for both the color frames and the alpha frames. The controller 1004 coordinates the operation of the display processor 1002, including switching between which buffer 1010, 1012, 1014, 1016, 1020, 1022, 1024, 1026 is to provide data as the output 1022 to the display screen (e.g., display screen 102). The display processor 1002 can be implemented as a standalone component (e.g., a GPU), or as part of another component (e.g., a CPU).

The display processor 1002 is similar to the display processor 402 of FIG. 4, except that the display processor 1002 is designed for use with a stereo display content overlay system. A stereo display content overlay system includes the various components discussed above, and also allows for stereo display. Stereo display refers to different images being displayed for the left eye than for the right eye, allowing emitted light images to be viewed as 3-dimensional (3D) images. In one or more implementations, the display content overlay system is implemented as a stereo display using a shutter system. The shutter system operates to alternate between blocking off the left eye view of the screen 102 so that images for the right eye can be displayed, and blocking off the right eye view of the screen 102 so that images for the left eye can be displayed.

The video buffers in the left side 1006 store data for display to the left eye. With two sets of buffers 1018 and 1020, one set of buffers is used to provide data as the output 1042 for the left eye while the other set of buffers is having new video data 1040 for the left eye written into them. Similarly, the video buffers in the right side 1008 store data for display to the right eye. With two sets of buffers 1028 and 1030, one set of buffers is used to provide data as the output 1042 for the right eye while the other set of buffers is having new video data 1040 for the right eye written into them.

The controller 1004 repeatedly goes through having a sequence of video buffers to provide data as the output 422. For example, the sequence can be a color frame buffer for the left eye, then a color frame buffer for the right eye, then an alpha frame buffer for the left eye, then an alpha frame buffer for the right eye. By way of another example, the sequence can be a color frame buffer for the left eye, then an alpha frame buffer for the left eye, then a color frame buffer for the right eye, then an alpha frame buffer for the right eye. Thus, for example, an ordering of buffers providing data as the output 422 would be: color frame buffer 1010, color frame buffer 1020, alpha frame buffer 1012, alpha frame buffer 1022, color frame buffer 1014, color frame buffer 1024, alpha frame buffer 1016, alpha frame buffer 1026.

The controller 1004 thus operates analogously to the controller 404 of FIG. 4, except that the controller 1004 is switching between video buffers in the left side 1006 and the right side 1008 as well as, for the left eye view and the right eye view, switching between sets of video buffers.

By switching the alpha and color frame buffers within each of the left side 1006 and the right side 1008 in sets, a pair of color frame buffer and alpha frame buffer are always the current set of buffers to provide data as the output 1042. If a frame drop occurs and the next color frame or alpha frame within the left side 1006 or the right side 1008 is not ready, the controller 1004 will not switch the set of buffers within that side. This avoids tearing caused by displaying data from two different frames in a single drawing of the display screen 102. This also results in the current color frame and the current alpha frame being displayed again, and then switching the set of buffers. The display processor 1042 thus avoids the situation where an alpha frame is displayed instead of a color frame, or a color frame is displayed instead of an alpha frame. Additionally, pairing left and right views into sets avoids stereo display problems in which the images are not properly paired for stereo visual consumption.

If the display processor 1002 did not use two sets of buffers within each of the left side 1006 and the right side 1008, the display processor 1002 could provide a color frame as the data for the output 1042 when an alpha frame is expected, or provide an alpha frame as the data for the output 1042 when a color frame is expected, analogous to the discussion above regarding quad buffering.

In one or more implementations, the display rate of a stereo display content overlay system is at least twice that of a display content overlay system implementing a quad buffer display content overlay system. This is because twice as many frames need to be displayed in the stereo display content overlay system due to displaying different images for the left eye and the right eye. Thus, for example, if the quad buffer display content overlay system discussed above were to be using a display rate of 120 Hz, the stereo display content overlay system would be using a display rate of at least 240 Hz.

Hex Buffering

Figure 11:
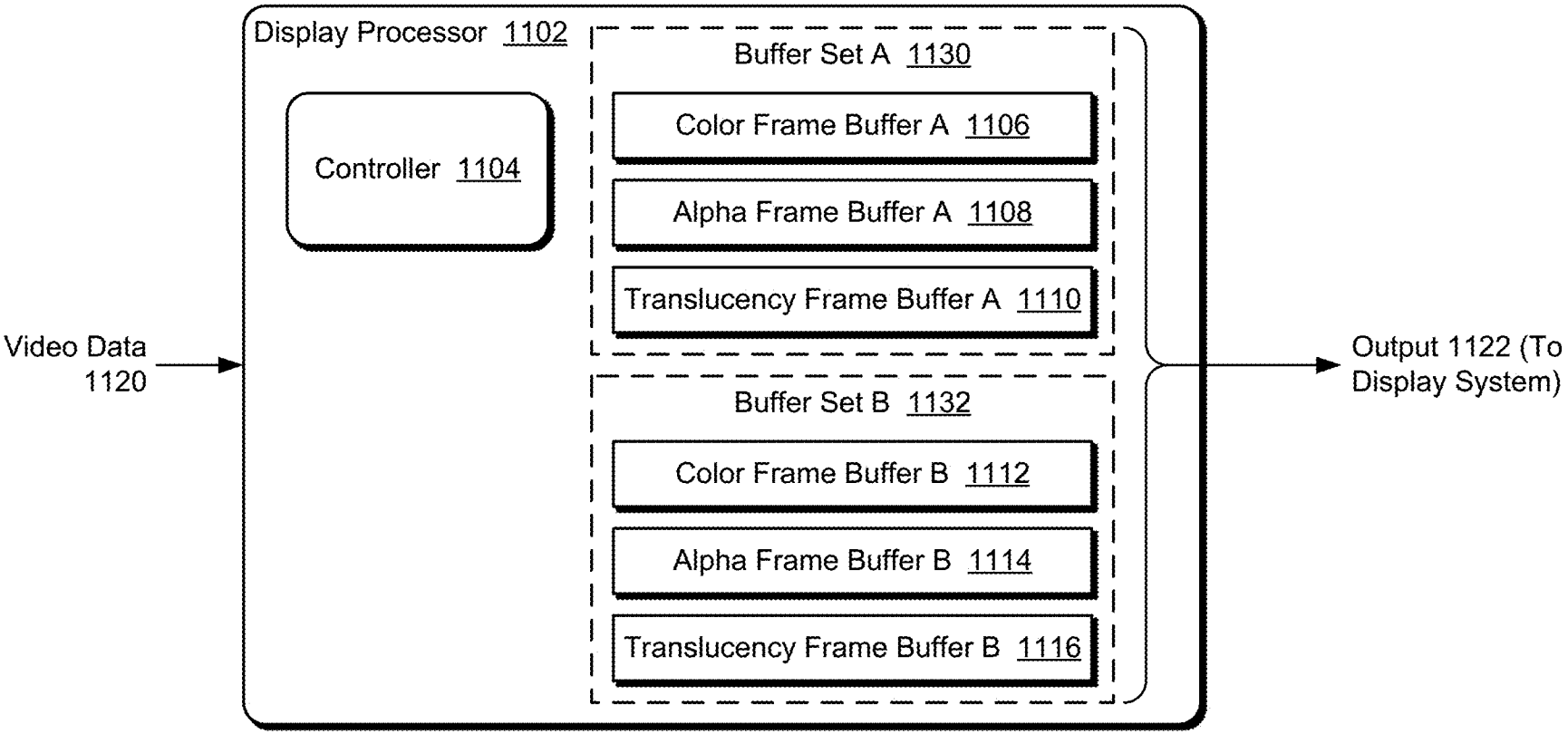
FIG. 11 illustrates an example display processor using six video buffers to generate the display on a display screen.

FIG. 11 illustrates an example display processor 1102 that implements some of the techniques discussed herein. In particular, the display processor 1102 implements hex buffering of data for output to the display system 110. As used herein, the term "hex buffering" refers to the use of six video buffers to display the content on the display system 110. The display processor includes a controller 1104, a color frame buffer A 1106, an alpha frame buffer A 1108, a translucency frame buffer A 1110, a color frame buffer B 1112, an alpha frame buffer B 1114, and a translucency frame buffer B 1116. Video data 1120 is received by the display processor 1102 from a digital overlay manager that generates, plays back, or otherwise provides the emitted light image. The video data 1120 includes data for the color frames, the alpha frames, and the translucency frames. The controller 1104 coordinates the operation of the display processor 1102, including switching between which buffer 1106, 1108, 1110, 1112, 1114, and 1116 is to provide data as the output 1122 to the display system (e.g., display system 110). The display processor 1102 can be implemented as a standalone component (e.g., a GPU), or as part of another component (e.g., a CPU).

As used herein, the term "translucency frame" refers to data describing one frame of a translucency image that corresponds to a color frame. The translucency image controls the transparency of the LCD screen.

In one or more implementations, the display processor 1102 is configured for use with a diffuser element that is controllable on a pixel-by-pixel basis. FIG. 3 discusses only two states for each of the components of the digital content overlay system. However, additional states are possible (such as a third state and/or a fourth state). For example, in some implementations the digital content overlay system utilizes a third state to control for translucency of a digital overlay. To illustrate, in one or more implementations, the translucency image controls the transparency of the LCD screen while the diffuser element 104 is in the diffusing (scatter) state and the illumination of the scene is enabled (the ambient light source 108 is turned on or flashed on)

while the direct illumination of the LCD screen is disabled (the direct light source 106 is turned off).

Thus, by utilizing this third state, the digital content overlay system can change a level of blur to provide a frosted glass-type overlay by adjusting an amount of scattering done by the diffuser element on a pixel-by-pixel basis. In particular, the digital content overlay system can control transparency based on a transparency mask image (in a first state), can control color based on an emitted light image (in a second state), and can control translucency based on a translucency image (in a third state).

The display processor 1102 is similar to the display processor 402 of FIG. 4, except that the display processor 1102 is designed for use with three different types of frames. The controller 1104 repeatedly goes through having a sequence of video buffers provide data as the output 1122, the sequence being a color frame buffer, an alpha frame buffer, and a translucency frame buffer.

The frame buffers 1106-1116 are organized into two sets: buffer set A 1130 and buffer set B 1132. With two sets of buffers 1130, 1132, one set of buffers is used to provide data as the output 1122 while the other set of buffers is having new video data 1120 written into them. At some point, typically at every third Vsync, the controller 1104 switches which set of buffers is providing data as the output 1122 and which set of buffers is having new video data 1120 written into them. The controller 1104 operates analogously to the controller 404 of FIG. 4, except that the controller 1104 is switching between two sets of three buffers each rather than two sets of two buffers each.

By switching between the two sets of buffers 1130, 1132, a set of color frame buffer, alpha frame buffer, and translucency frame buffer are always the current set of buffers to provide data as the output 1122. If a frame drop occurs and the next color frame, alpha frame, or translucency frame is not ready, the controller 1104 will not switch the set of buffers. In the case where the next color frame or alpha frame is not ready, this avoids tearing caused by displaying data from two different frames in a single drawing of the display screen 102. This also results in the current color frame, the current alpha frame, and the current translucency frame being displayed again, and then switching the set of buffers (e.g., at the next Vsync). The display processor 1122 thus avoids the situations where an alpha frame is displayed instead of a color frame or a translucency frame, a color frame is displayed instead of an alpha frame or a translucency frame, or a translucency frame is displayed instead of a color frame or an alpha frame.

If the display processor 1102 did not use two sets of buffers, the display processor 1102 could provide a color frame as the data for the output 1122 when an alpha frame or a translucency frame is expected, provide an alpha frame as the data for the output 1122 when a color frame or translucency frame is expected, or provide a translucency frame as the data for the output 1122 when a color frame or an alpha frame is expected. Given the very different content of alpha frames, color frames, and translucency frames, the display of a color frame or a translucency frame rather than an intended alpha frame, or the display of an alpha frame or translucency frame rather than an intended color frame, can appear as bright flashes to the user. The display of a color frame or alpha frame rather than an intended translucency frame can result in unintended translucency.

In one or more implementations, the display rate of a display content overlay system using hex buffers is at least 1.5 times that of a display content overlay system implementing a display content overlay system using quad buffers. This is because 1.5 times as many frames are output by the display processor 1102. Thus, for example, if the display content overlay system using quad buffers discussed above were to be using a display rate of 120 Hz, the content overlay system using hex buffers would be using a display rate of at least 180 Hz.

Figure 12:
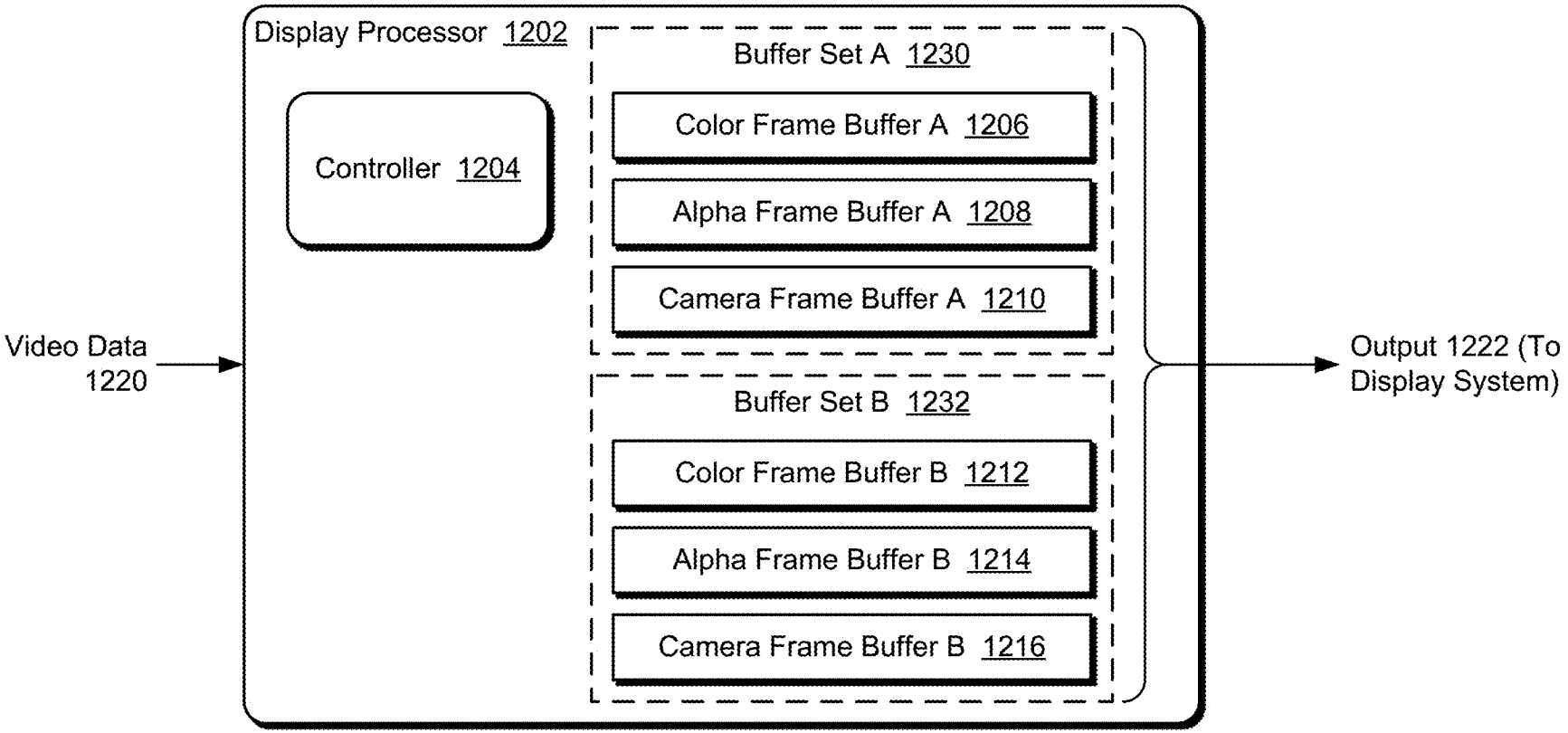
FIG. 12 illustrates another example display processor using six video buffers to generate the display on a display screen.

FIG. 12 illustrates another example display processor 1202 that implements hex buffering. The display processor includes a controller 1204, a color frame buffer A 1206, an alpha frame buffer A 1208, a camera frame buffer A 1210, a color frame buffer B 1212, an alpha frame buffer B 1214, and a camera frame buffer B 1216. Video data 1220 is received by the display processor 1202 from a digital overlay manager that generates, plays back, or otherwise provides the emitted light image. The video data 1220 includes data for the color frames, the alpha frames, and the camera frames. The controller 1204 coordinates the operation of the display processor 1202, including switching between which buffer 1206, 1208, 1210, 1212, 1214, and 1216 is to provide data as the output 1222 to the display system (e.g., display system 110). The display processor 1202 can be implemented as a standalone component (e.g., a GPU), or as part of another component (e.g., a CPU).

As used herein, the term "camera frame" refers to data describing an image displayed so that a camera behind the diffuser element 104 can capture a reflection off the display system 110. In one or more implementations, the camera frame includes data to display black on the display screen 102.

Additionally or alternatively, because the content of the camera frame is a black image, the camera frame buffers (e.g., color frame buffers 1210 and 1216) can be replaced by custom circuits to generate a black image directly, during that frame time. The use of such custom circuits reduces the amount of memory used to implement the buffer sets 1230 and 1232.

Figure 13:
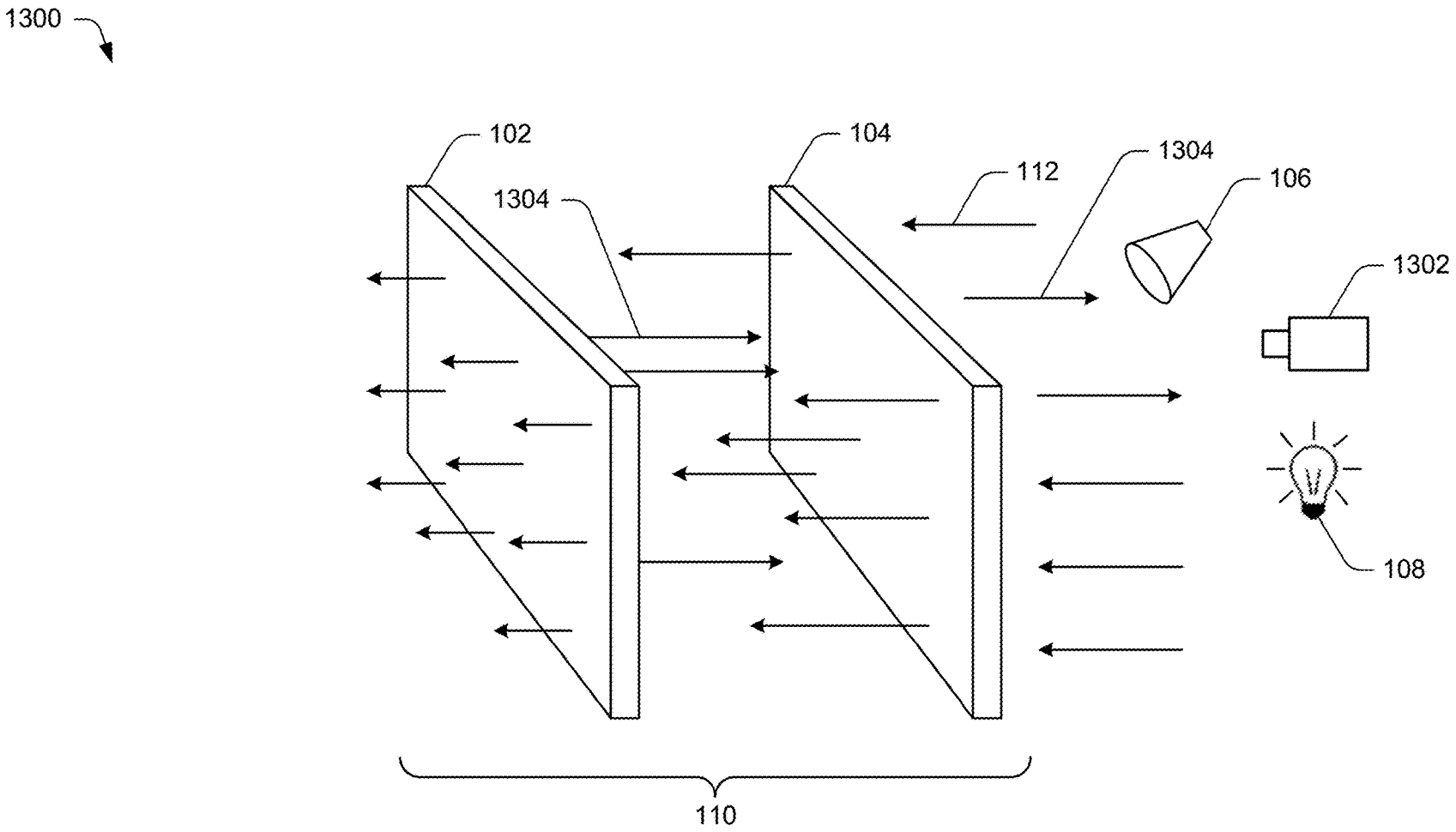
FIG. 13 illustrates an example environment including a camera located behind a diffuser element.

FIG. 13 illustrates an example environment 1300 including a camera located behind the diffuser element. As illustrated, the example environment 1300 includes a display screen 102, a diffuser element 104, a diffuser direct light source 106, an ambient light source 108 and a camera 1302 in accordance with one or more implementations. The environment 1300 is analogous to the environment 100 of FIG. 1, except that the environment 1300 includes the camera 1302. In the example environment 1300, the display screen 102 is in a masking state and the diffuser element 104 is in a transparent state. The display screen 102 displays a black screen, causing the scene behind the diffuser element 104 (the background view) to be reflected off the display screen 102 and pass through the diffuser element 104 in the transparent state, illustrated as reflection 1304. For example, the background view 702 of FIG. 7, including a bottle and a glass of wine sitting on a table behind the diffuser element 104, can be reflected back to the camera 1302.

The camera 1302 captures an image of the reflection 1304 and communicates the captured image to the digital overlay manager that generates, plays back, or otherwise provides the emitted light image. The digital overlay manager thus has an image of the background view and can use this image in any of a variety of different manners. For example, the digital overlay manager can generate an environment map of the background view and use that environment map when generating the emitted light image to display objects that look as if they are refractive, like water or diamonds. The user could then see through the refractive objects to see the background view. The emitted light image can also create the appearance of frosted glass by filtering regions of the environment map to compute the color of emissive pixels in the display screen 102.

Another way the program can use the environment map is to determine where to place objects in the emitted light image and/or how to move objects in the emitted light image so that the objects appear to the user as interacting with the background view. For example, the emitted light image can be changed to move the location of a waterfall so that the water appears to be falling into a glass in the background view. By way of another example, the background view may include a rotating turntable, and the program can generate and move one or more objects in the emitted light image so that the objects appear to the user as rotating on top of the turntable. By way of yet another example, the background view may include a rotating turntable, and the program can display different objects as the emitted light image based on the angle or position of the turntable.

Figure 14:
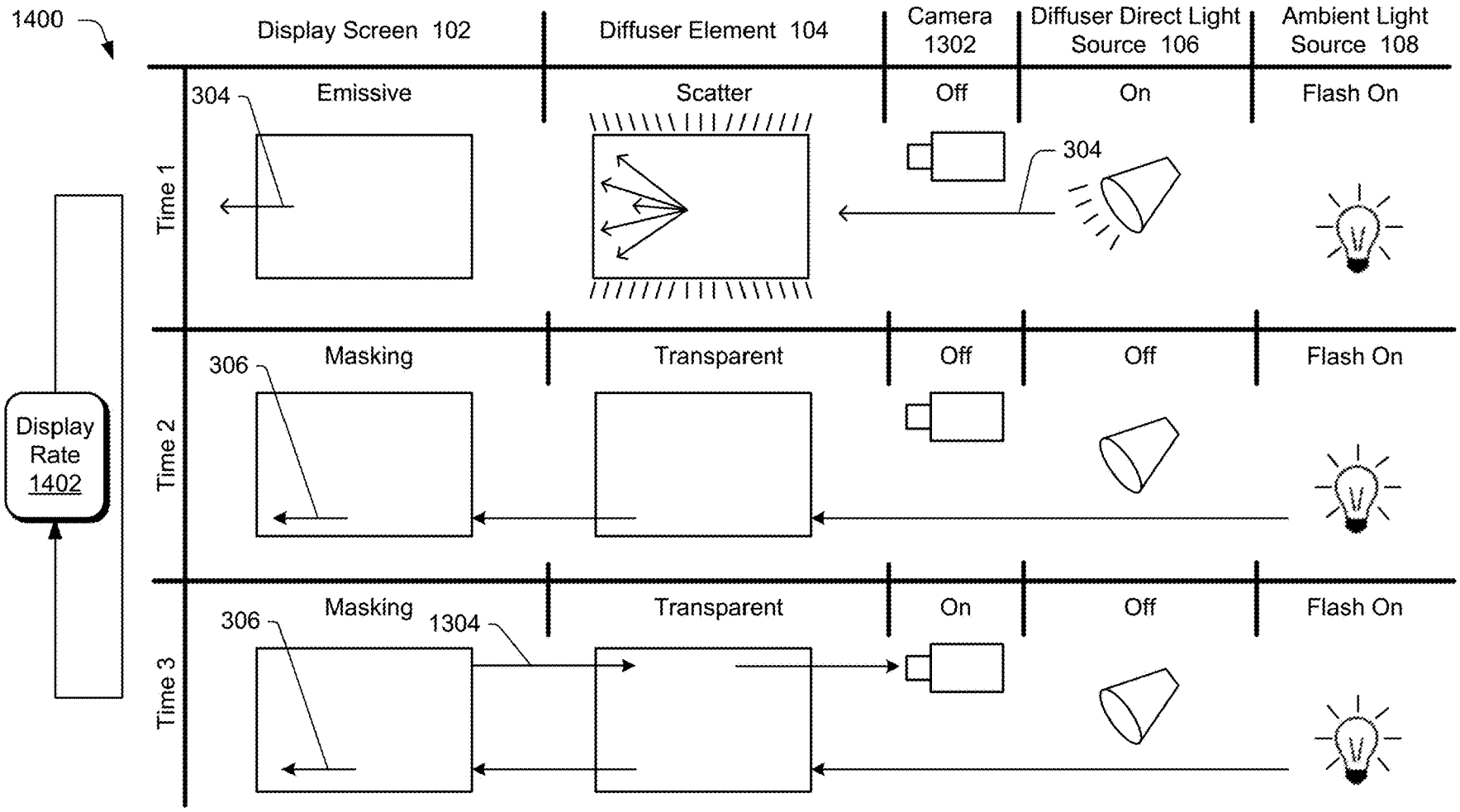
FIG. 14 illustrates an example flow depicting the respective states of a display screen, a diffuser element, a diffuser direct light source, an ambient light source, and a camera.

FIG. 14 illustrates a flow 1400 with "Time 1", "Time 2", and "Time 3" depicting the respective states of the display screen 102, the diffuser element 104, the diffuser direct light source 106, the ambient light source 108, and the camera 1302. The flow 1400 is similar to the flow 300 of FIG. 3, except that the flow 1400 includes "Time 3" and the state of the camera 1302.

In particular, the flow 1400 includes a display rate clock 1402 which toggles the components (e.g., the display screen 102, the diffuser direct light source 106, the diffuser 104, the ambient light source 108, and the camera 1302) between their respective states as they repeatedly cycle through Time 1, Time 2, and Time 3. The display rate clock 1402 may toggle the components between their respective states at any of a variety of rates, analogous to the display rate clock 302 of FIG. 3. Further, the display rate clock 1402 may toggle components between their respective states at an even ratio based on a display rate, or at a different ratio, analogous to the display rate clock 302 of FIG. 3.

As illustrated in FIG. 14, at Time 1 the digital content overlay system sets the display screen 102 to an emissive state, the diffuser element 104 to a scatter state, the camera 1302 to an off state, the diffuser direct light source 106 to an on state, and the ambient light source 108 to a flash on state. While in the off state, the camera 1302 does not capture images. The diffuser direct light source 106 projects light toward the diffuser element 104. For example, the diffuser direct light source 106 projects a light wave 304 toward the diffuser element 104. Because the diffuser element 104 is in the scatter state, the diffuser element 104 scatters the light wave 304 to produce a cone of light rays, and the diffuser element 104 glows evenly to emit light for the display screen 102. Thus, the display screen 102 filters the light 304 that passes through it to display an emitted light image.

FIG. 14 also illustrates the states of the components at Time 2, where the digital content overlay system sets the display screen 102 to a masking state, the diffuser element 104 to a transparent state, the camera 1302 to an off state, the diffuser direct light source 106 to an off state, and the ambient light source 108 to a flash on state. As shown in FIG. 14, the ambient light source 108 projects a light wave 306 outward through the transparent diffuser element 104 and the display screen 102 (which may selectively attenuate light to display a transparency mask image). Accordingly, an observer may perceive the light wave 306 (together with other light waves) to see the scene behind the diffuser element 104 in addition to a transparency mask image.

FIG. 14 also illustrates the states of the components at Time 3, where the digital content overlay system sets the display screen 102 to a masking state, the diffuser element 104 to a transparent state, the camera 1302 to an on state, the diffuser direct light source 106 to an off state, and the ambient light source 108 to a flash on state. The ambient light source 108 projects a light wave 306 outward through the transparent diffuser element 104 and the display screen 102, which is displaying all black. The light wave 306 causes a reflection of the background view to appear on the back side of the display screen 102 (the side of the display screen facing the diffuser element 104), illustrated as the reflection 1304. When in the on state, the camera 1302 captures one or more images. Thus, at Time 3 the camera 1302 captures one or more images of the background view.

The digital content overlay system synchronizes these components (the display screen 102, the diffuser element 104, the camera 1302, the diffuser direct light source 106, and the ambient light source 108) and toggles the components between states at Time 1, Time 2 and Time 3. The digital content overlay system performs the toggling function according to the display rate (as illustrated by the display rate clock 1402) described above. Thus, the digital content overlay system can present a digital overlay associated with the emitted light image and an object view modulated by the transparency mask image at Time 2 that appear together as a composite image to the human eye, while capturing at Time 3 an image of the background view to aid in generating the emitted light image.

Returning to FIG. 12, the display processor 1202 is similar to the display processor 402 of FIG. 4, except that the display processor 1202 is designed to display data allowing a camera to capture the background view. The controller 1204 repeatedly goes through having a sequence of video buffers to provide data as the output 1222, the sequence being a color frame buffer, an alpha frame buffer, and a camera frame buffer. The data from the color frame buffer, the alpha frame buffer, and the camera frame buffer is provided to the display screen 102.

The frame buffers 1206-1216 are organized into two sets: buffer set A 1230 and buffer set B 1232. With two sets of buffers 1230, 1232, one set of buffers is used to provide data as the output 1222 while the other set of buffers is having new video data 1220 written into them. At some point, typically at every third Vsync, the controller 1204 switches which set of buffers is providing data as the output 1222 and which set of buffers is having new video data 1220 written into them. The controller 1204 operates analogously to the controller 404 of FIG. 4, except that the controller 1204 is switching between two sets of three buffers each rather than two sets of two buffers each.

By switching between the two sets of buffers 1230, 1232, a set of color frame buffer, alpha frame buffer, and camera frame buffer are always the current set of buffers to provide data as the output 1222. If a frame drop occurs and the next color frame, alpha frame, or camera frame is not ready, the controller 1204 will not switch the set of buffers. In the case where the next color frame or alpha frame is not ready, this avoids tearing caused by displaying data from two different frames in a single drawing of the display screen 102. This also results in the current color frame, the current alpha frame, and the current camera frame being displayed again, and then switching the set of buffers. The display processor 1222 thus avoids the situations where an alpha frame is displayed instead of a color frame or a camera frame, a color frame is displayed instead of an alpha frame or a camera frame, or a camera frame is displayed instead of a color frame or an alpha frame.

If the display processor 1202 did not use two sets of buffers, the display processor 1202 could provide a color frame as the data for the output 1222 when an alpha frame or a camera frame is expected, provide an alpha frame as the data for the output 1222 when a color frame or camera frame is expected, or provide a camera frame as the data for the output 1222 when a color frame or an alpha frame is expected. Given the different content of alpha frames, color frames, and camera frames, the display of a color frame or a camera frame rather than an intended alpha frame, the display of an alpha frame or camera frame rather than an intended color frame, or the display of a color frame or alpha frame rather than an intended camera frame can result in darkening or lightening the display as discussed above. Furthermore, the display of an alpha frame rather than an intended color frame or camera frame can appear as bright flashes to the user.

In one or more implementations, the display rate of a display content overlay system using hex buffers is at least 1.5 times that of a display content overlay system implementing a display content overlay system using quad buffers. This is because 1.5 times as many frames are output by the display processor 1402. Thus, for example, if the display content overlay system using quad buffers discussed above were to be using a display rate of 120 Hz, the content overlay system using hex buffers would be using a display rate of at least 180 Hz.

Fast Moving Objects

Situations can arise in which a program displaying an emitted light image desires to display, as the emitted light images, an object moving across the display screen 102. In one or more implementations, the program renders the color frames and alpha frames synchronized to each other. For example, a color frame with the object is displayed followed by an alpha frame with a transparency mask image at the same location in the alpha frame as the object was in the color frame.

Figure 15:
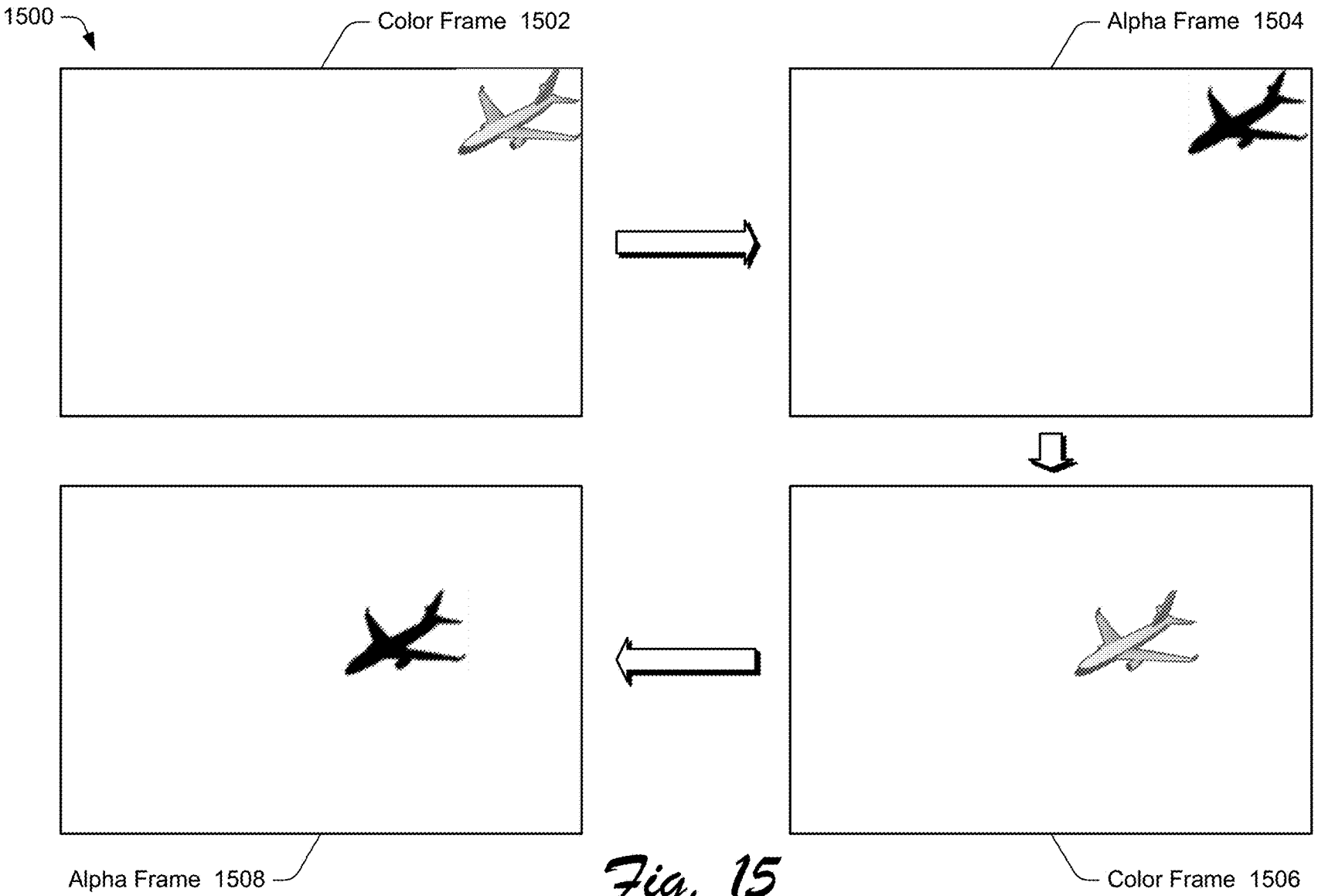
FIG. 15 illustrates an example of color frames and alpha frames synchronized to each other.

FIG. 15 illustrates an example 1500 of color frames and alpha frames synchronized to each other. The example 1500 is of an airplane moving quickly across the display screen 102. A color frame 1502 is displayed with the airplane in the top right corner, then an alpha frame 1504 is displayed with a transparency mask image of the airplane in the same location as the airplane was in the color frame 1502. A color frame 1506 is then displayed with the airplane having moved down and to the left, then an alpha frame 1508 is displayed with a transparency mask image of the airplane in the same location as the airplane was in the color frame 1506.

In situations where the object is displayed moving very fast across the display screen 102, synchronizing the color frames and the alpha frames to each other can lead to banding artifacts on the leading and trailing edges of the object. This is because generally the color frame adds light where the object is displayed on the display screen 102 and then the transparency mask image blocks out the background view where the object is on the display screen 102. A user tracking the moving object anticipates the rate at which the object is moving and the user's eyes have moved along the anticipated trajectory of the object, so the transparency mask image ends up blocking out an area not exactly where the user is looking, which results in the leading edge of the object looking too bright and the trailing edge of the object looking too dark.

To resolve these banding artifacts, if the object is displayed moving very fast across the display screen 102, the program can sample the color and transparency mask images at different time, closer to their times of display. Thus, the object is rendered at its location at the time the color frame is displayed and the alpha frame is rendered at its location at the time the alpha frame is displayed. For synthetic graphics, this may involve rendering the emitted light image one sub-frame in time later than the transparency mask image which preceded it. For captured video content, alternate frames can be used to produce the emitted light frame and the transparency frame. Alternatively, intermediate frames could be produced using optical flow and other algorithms, to effectively interpolate the frame time.

Figure 16:
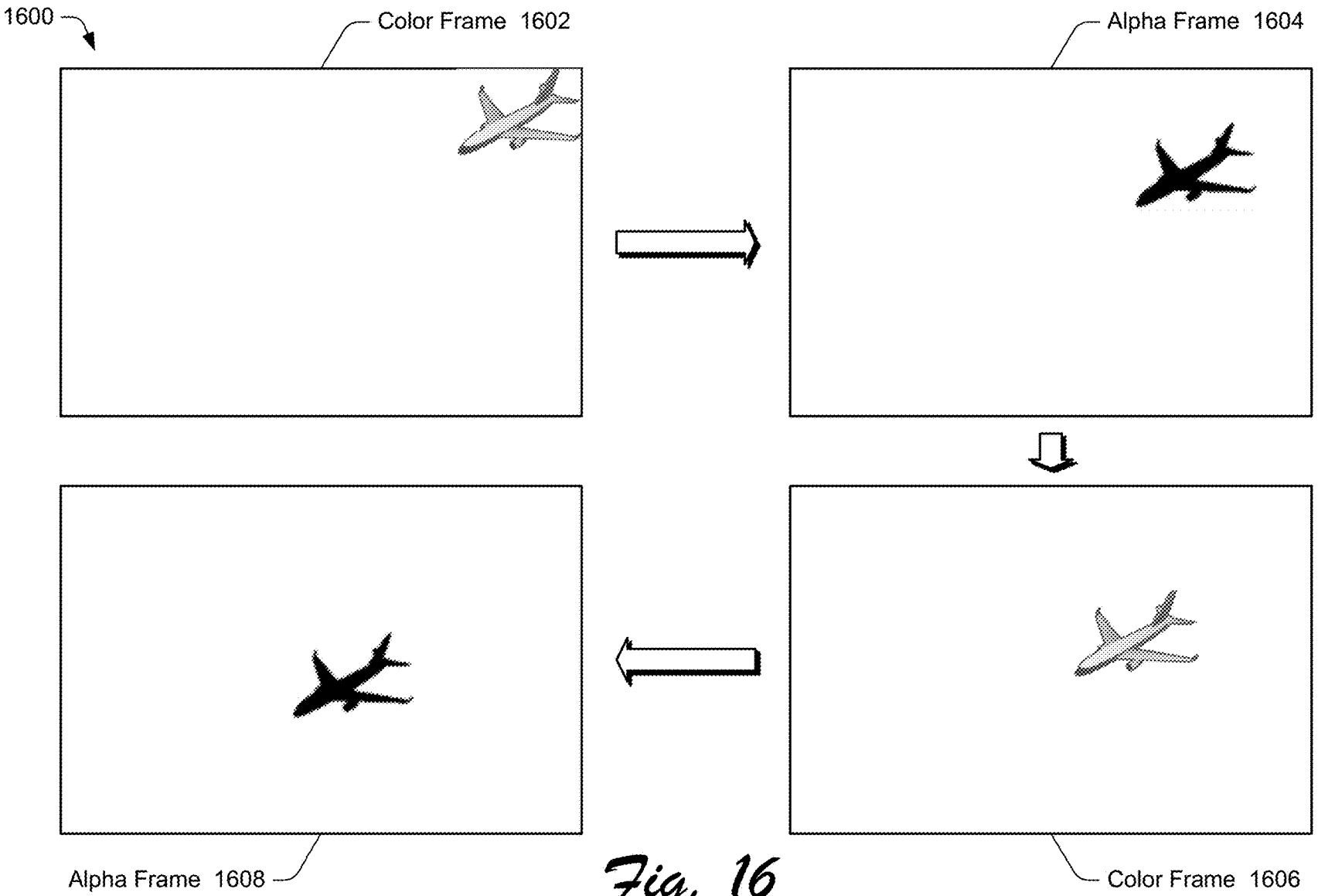
FIG. 16 illustrates an example of color frames and alpha frames synchronized to their times of display.

FIG. 16 illustrates an example 1600 of color frames and alpha frames synchronized to their times of display. The example 1600 is of an airplane moving quickly across the display screen 102. A color frame 1602 is displayed with the airplane in the top right corner, then an alpha frame 1604 is displayed with a transparency mask image of the airplane having moved down and to the left. A color frame 1606 is then displayed with the airplane having moved further down and to the left, then an alpha frame 1608 is displayed with a transparency mask image of the airplane having moved even further down and to the left. As illustrated in example 1600, the transparency mask image of the airplane in the alpha frame 1604 is not in the same location as the airplane was in the color frame 1602, and the transparency mask image of the airplane in the alpha frame 1606 is not in the same location as the airplane was in the color frame 1608.

Bright Highlights

As discussed above, if the emitted light image is desired to be transparent then the locations in the alpha frame that are part of the transparency mask image are a value between white and black, with values closer to black indicating less transparency of the emitted light image and values closer to white indicating more transparency of the emitted light image. The transparency mask image can be leveraged to make certain portions of the emitted light image appear brighter than the background view.

A desired portion of the emitted light image can be made to appear brighter to the user than the background view by setting the pixels for the desired portion to white in the color frame and setting corresponding pixels in the transparency mask image to be more transparent. For example, in the RGB color space, where r, g, b values of 0, 0, 0 represent black, the corresponding pixels in the transparency mask image can be set to 50, 50, 50.

By making the corresponding pixels in the transparency mask image more transparent, additional light is let through from the background view at those corresponding pixels, making the emitted light image displayed at the desired portion appear to the user to be slightly brighter. The desired portion appears slightly brighter than the background view despite the light falling at the desired portion on a diffuser between the background view and the user's eyes.

This technique for making a portion of the emitted light image appear brighter is particularly useful when the portion is intended to be transparent, such as along the edges of water droplets that are displayed.

Display Synchronization

Given the alternating display of color frames and alpha frames, care should be taken in designing the digital content overlay system to avoid artifacts that are noticeable or unacceptable to the user. One possible source of such artifacts is the display system 110 itself. When pixel values on an LCD display screen 102 are changed, the change is made sequentially (e.g., in a scanning manner from the upper left corner of the display screen 102 to the lower right corner of the display screen 102). However, changes to the state of the diffuser element 104 are made in parallel (e.g., the state of the entire diffuser element 104 is changed concurrently) if the diffuser element 104 is not segmented or does not have pixelwise control. This difference in the manner in which changes are made in the display screen 102 and the diffuser element 104 can result in various artifacts, such as loss of contrast.

Various different techniques can be used to resolve these artifacts resulting from the difference in the manner in which changes are made in the display screen 102 and the diffuser element 104. One such technique is to synchronize the ambient light source 108 to be on for less than a frame time (e.g., flash the ambient light source 108 on at the end of each frame as discussed above). The amount less that the ambient light source 108 is on can vary, such as being on for only 80% of the frame time. For example, if 144 frames per second are displayed at a particular display rate, then the frame time is 1÷144=0.00694 seconds. In this example, if the ambient light source 108 is on for 75% of the frame time, then the ambient light source 108 is on for 0.00521 seconds during each frame time.

Another technique to resolve the artifacts resulting from the difference in the manner in which changes are made in the display screen 102 and the diffuser element 104 is to use a diffuser element 104 that is segmented. In one or more implementations, the diffuser element 104 is not segmented, so the state of the diffuser element 104 is either scatter or transparent. There is no ability to set such a diffuser to have one portion be in the scatter state while another portion is in the transparent state.

However, a segmented diffuser element 104 is able to have some portions in the scatter state while other portions are in the transparent state. An example of such a segmented diffuser element 104 is a diffuser element 104 that is locally controllable on a pixel-by-pixel basis where individual pixels (or groups of pixels) can be in a scatter state while other pixels are in a transparent state as discussed above. The changing of state of a segmented diffuser element 104 is synchronized to the sequential scanning change of the LCD display screen 102. This allows the change in pixels (or groups of pixels) of the segmented diffuser element 104 to be changed at the same time (or approximately the same time) as the corresponding pixels in the LCD display screen 102. For example, if the segmented diffuser element 104 is controllable on a pixel-by-pixel basis, the pixels in the segmented diffuser element 104 can be updated sequentially (e.g., in a scanning manner from the upper left corner of the diffuser element 104 to the lower right corner of the display screen 104) at the same time and at the same rate as the pixel values on an LCD display screen 102 are changed.

Another example of such a segmented diffuser element 104 is a diffuser element 104 that is made of horizontal or vertical bands (aligned with the scan pattern of the LCD display screen 102) and is synchronized to the LCD display screen 102. The size of these bands can vary, such as being 10-20 scan lines, 10% of the size of the diffuser element 104, and so forth. The changing of state of a segmented diffuser element 104 is synchronized to the sequential scanning change of the LCD display screen 102. For example, if the segmented diffuser element 104 is controllable on a band-by-band basis, the bands in the segmented diffuser element 104 can be updated sequentially (e.g., in a scanning manner from the upper left corner of the diffuser element 104 to the lower right corner of the display screen 104) at the same time as the corresponding pixels of the LCD display screen 102 are changed.

Figure 17:
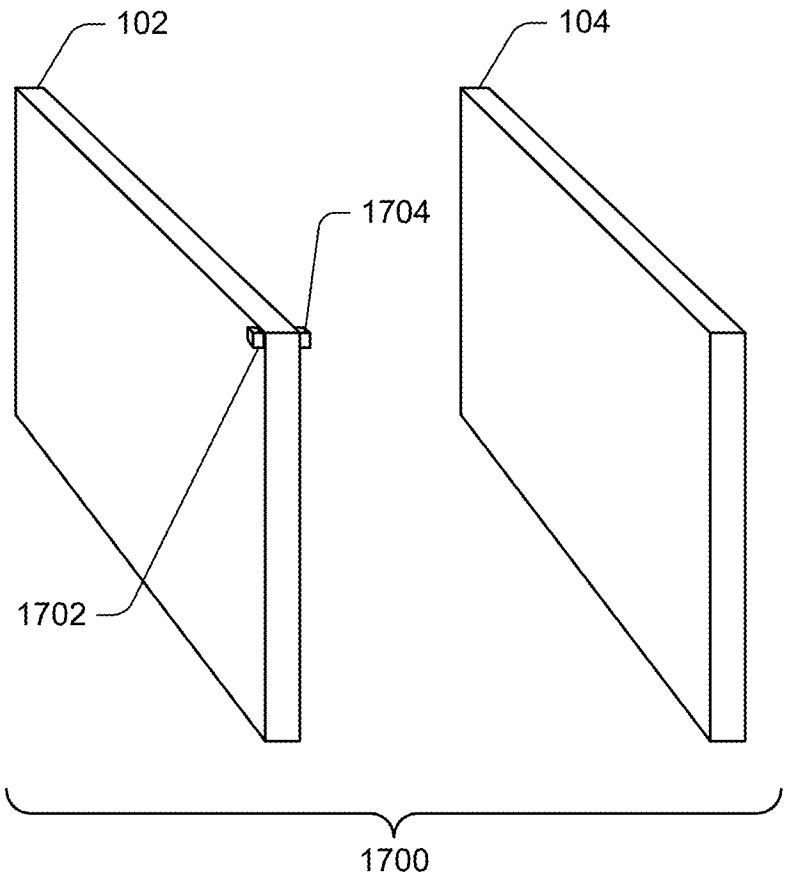
FIG. 17 illustrates an example of a hardware-based solution to synchronizing switching of the video buffers with changing the state of the diffuser element.

Similarly, in one or more implementations switching the video buffers is synchronized with changing the state of the diffuser element using a hardware-based solution. FIG. 17 illustrates an example of a hardware-based solution to synchronizing switching of the video buffers with changing the state of the diffuser element. As illustrated, the example display system 1700 that includes a display screen 102 and a diffuser element 104. The display system 1700 can be any of the display systems discussed above, such as the display systems 110 discussed with reference to FIGS. 1, 2, and/or 13. The display screen 102 and the diffuser element 104 are analogous to the display screens discussed above, except that a phototransistor 1702 and a saturating LED 1704 are situated on opposite sides of the display screen 102.

One or more phototransistors 1702 are situated on the display screen 102 at a particular area of one or more pixels. The video frames provided to the display screen 102 are generated so that the one or more pixels in that particular area of each frame include one of two colors (e.g., black or white) based on the desired state of the diffuser element 104. The one or more phototransistors sense whether that particular area is black or white, and toggle the diffuser element 104 accordingly. For example, the diffuser element 104 is set to the scatter state if that particular area is black and set to the transparent state if that particular area is white.

One or more saturating LEDs 1704 are situated on the opposite side of the display screen 102 from the one or more phototransistors 1702. The one or more saturating LEDs 1704 illuminate the one or more pixels of the display screen 102 over which the one or more phototransistors 1702 are situated. The one or more saturating LEDs 1704 illuminate these pixels for all types of frames. This makes the one or more phototransistors 1702 indifferent to ambient light (e.g., an ambient light source 108).

This hardware-based solution synchronizes the diffuser element 104 with the display processor changing which frame buffer is providing its frame to the display screen 102 without a direct software link between the display processor and the diffuser element. Delays may be imposed by the operating system of the device implementing the display processor when sending a signal from the display processor to the diffuser element (e.g., via the serial COM port). These delays can lead to synchronization issues, which are avoided by the hardware-based solution.

Combinations

Various different aspects of controlling an augmented reality display with transparency control are discussed herein. It should be noted that a digital content overlay system can implement various combinations of these different aspects. For example, camera frame buffers or translucency frame buffers can be included with the 8-buffer stereo implementation, resulting in a 12-buffer implementation. By way of another example, camera frame buffers and translucency frame buffers can be included with the 8-buffer stereo implementation, resulting in a 16-buffer implementation.

Furthermore, the various techniques discussed herein with reference to the fast moving objects, bright highlights, and display synchronization can be combined together and/or used with any of the display processor implementations discussed herein.

The attenuating display (LCD) could be a greyscale display, rapidly displaying sequential images in a way that is synchronized to the corresponding colors being emitted by the LEDs illuminating the box. This would have a higher frame rate but would allow for a mode in which the transparency mask image was only greyscale rather than color, which may increase the energy efficiency of the display.

Example Procedures

The following discussion describes techniques that may be implemented utilizing the previously described systems and devices. Aspects of the procedure may be implemented in hardware, firmware, software, or a combination thereof. The procedure is shown as a set of blocks that specify operations performed by one or more devices and are not necessarily limited to the orders shown for performing the operations by the respective blocks. In portions of the following discussion, reference will be made to FIGS. 1-17.

Figure 18:
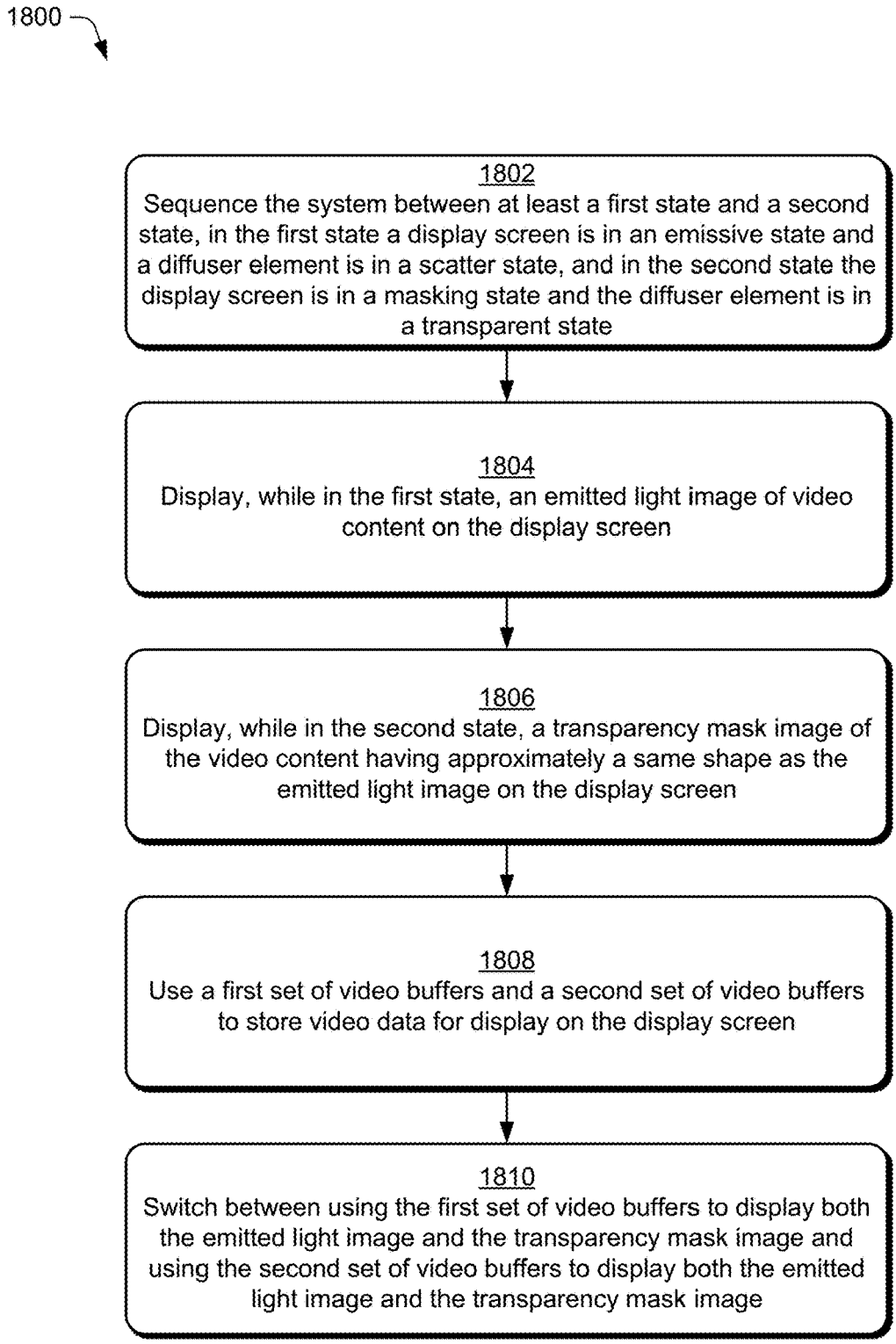
FIG. 18 is a flow diagram depicting a procedure in an example implementation of controlling an augmented reality display with transparency control using multiple sets of video buffers.

FIG. 18 is a flow diagram depicting a procedure in an example implementation of controlling an augmented reality display with transparency control using multiple sets of video buffers. In this example, a system is repeatedly sequenced between at least a first state and a second state (block 1802). In the first state a display screen is in an emissive state and a diffuser element is in a scatter state. In the second state the display screen is in a masking state and the diffuser element is in a transparent state. The system also optionally includes one or more additional states in the sequence, such as third state in which the display screen is in the emissive state and the diffuser element in in the transparent state as discussed above.

While in the first state, an emitted light image of video content is displayed on the display screen (block 1804). The emitted light image includes one or more objects that are displayed as an overlay on a background view.

While in the second state, a transparency mask image of the video content is displayed on the display screen (block 1806). The transparency mask image operates to block some of the light from the background view from passing through the display screen while the diffuser element is in the transparent state.

A first set of video buffers and a second set of video buffers are used to store video data for the display screen (block 1808). The first set of video buffers includes a first color frame buffer to store data describing a first color frame of the emitted light image, and a first alpha frame buffer to store data describing a first transparency mask image that corresponds to the first color frame. The second set of video buffers includes a second color frame buffer to store data describing a second color frame of the emitted light image and a second alpha frame buffer to store data describing a second transparency mask image that corresponds to the second color frame. The first and second sets of video buffers also optionally include additional frame buffers, such as translucency frame buffers and/or camera frame buffers.

The system switches between using the first set of video buffers to display both the emitted light image and the transparency mask image and using the second set of video buffers to display both the emitted light image and the transparency mask image (block 1810). This results in the data from a video buffer being displayed on the display screen while the diffuser element is in the emissive state, and data from an alpha buffer being displayed on the display screen while the diffuser element is in the transparent state.

Example System and Device

Figure 19:
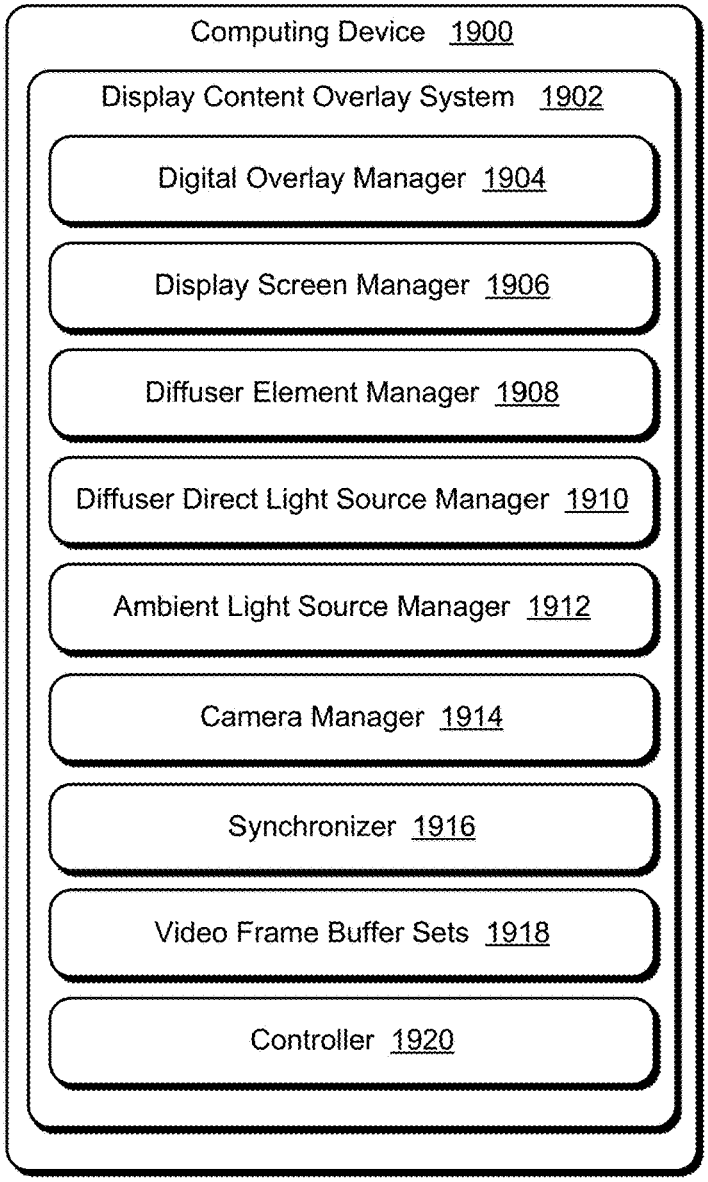
FIG. 19 illustrates an example computing device implementing a digital content overlay system.

FIG. 19 illustrates an example computing device 1900 implementing a digital content overlay system 1902. The display content overlay system is implemented at least in part in hardware, and optionally can be implemented in part in software and/or firmware. As shown in FIG. 19, the digital content overlay system 1902 may include a digital overlay manager 1904, a display screen manager 1906, a diffuser element manager 1908, a diffuser direct light source manager 1910, an ambient light source manager 1912, a camera manager 1914, a synchronizer 1916, video frame buffer sets 1918, and a controller 1920. While FIG. 19 depicts a particular number of components, in some embodiments, the digital content overlay system 1902 may include more or fewer components. For example, the display content overlay system 1902 may not include the camera manager 1914. In addition, the components may perform additional or alternative tasks than those described hereafter.

The digital overlay manager 1904 manages, generates, animates, plays back, and/or creates digital content for display by way of a display screen. For example, the digital overlay manager 1904 generates digital content (e.g., emitted light images and/or transparency mask images, translucency images, black images) including text, images, icons, etc., in response to user input to design the digital content. The digital overlay manager 1904 may further generate digital content that appears to interact with a tangible real-world object that appears behind a display screen (e.g., within a display case). For instance, the digital overlay manager 1904 may generate a digital animation of digital content that virtually interacts with an object on display within the display case (e.g., emitted light images and/or transparency mask images that when combined portray the digital overlay). For example, the background view may include a rotating turntable, and the program can generate and move one or more objects in the emitted light image so that the objects appear to the user as rotating on top of the turntable.

The display screen manager 1906 renders, rasterizes, presents, or otherwise displays digital content by way of a display screen, such as display screen 102 discussed above. The display screen manager 1906 also toggles, switches, alternates, or transitions the display screen between an emissive state and a masking state, as described above. In the emissive state, the display screen manager 1906 activates the display screen to filter light to display digital content (e.g., an emitted light image). In the masking state, the display screen manager 1906 changes the active areas (e.g., pixels) on the display screen to passively allow some light to travel through the display screen while selectively filtering other light to display a background view attenuated by a transparency mask image.

The diffuser element manager 1908 manages or controls a diffuser element, such as diffuser element 104 discussed above. For example, the diffuser element manager 1908 toggles, switches, alternates, or transitions the diffuser element from a scatter state to a transparent state and vice-versa. For example, the diffuser element manager 1908 sends an electrical signal to stimulate molecules within the diffuser element to turn transparent.

The diffuser direct light source manager 1910 manages or controls a diffuser direct light source, such as the diffuser direct light source 106 discussed above. For example, the diffuser direct light source manager 1910 toggles, switches, alternates, or transitions the diffuser direct light source from an on state to an off state and vice-versa, in accordance with the disclosure herein.

The ambient light source manager 1912 manages or controls an ambient light source, such as the ambient light source 108 discussed above. For example, the ambient light source manager 1912 toggles, switches, alternates, or transitions the ambient light source from an on state (or a flash on state) to an off state and vice-versa, in accordance with the disclosure herein.

The camera manager 1914 manages or controls a camera or other image capture device, such as the camera 1302 discussed above. For example, the camera manager 1912 toggles, switches, alternates, or transitions the camera from an on state to an off state and vice-versa, in accordance with the disclosure herein.

The synchronizer 1916 communicates with one or more of the display screen manager 1906, the diffuser element manager 1908, the diffuser direct light source manager 1910, the ambient light source manager 1912, and/or the camera manager 1914 to synchronize, time, trigger, align, or otherwise initiate the transitions of the display screen, the diffuser direct light source, the diffuser element, the ambient light source, and/or the camera in accordance with the disclosure herein.

The video frame buffer sets 1918 include at least two sets of video frame buffers, each set of video frame buffers including at least a color frame buffer and an alpha frame buffer. Each set of video frame buffers optionally also includes a translucency frame buffer, and a camera frame buffer. The video frame buffer sets 1918 can be, for example, sets 414 and 416, sets 1018, 1020, 1028, and 1030, sets 1130 and 1132, sets 1230 and 1232, as discussed above.

The controller 1920 switches between which video frame buffer set 1918 is to provide data as the output to the display screen (e.g., display screen 102). This can occur, for example, at a Vsync. The controller 1920 can be, for example, a controller 404, a controller 1004, a controller 1104, or a controller 1204 as discussed above.

Figure 20:
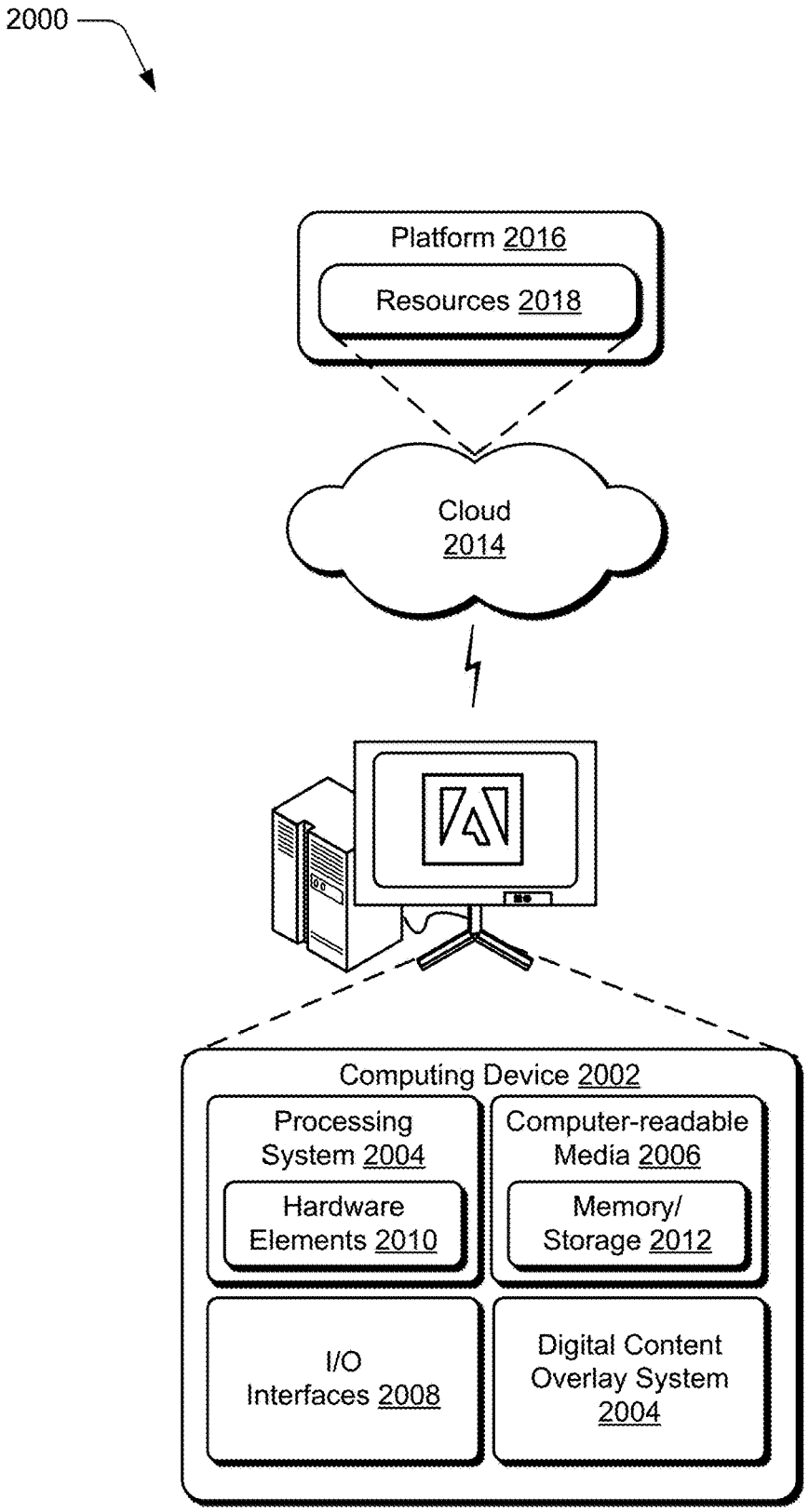
FIG. 20 illustrates an example system including various components of an example device that can be implemented as any type of computing device as described and/or utilize with reference to FIGS. 1-19 to implement aspects of the techniques described herein.

FIG. 20 illustrates an example system generally at 2000 that includes an example computing device 2002 that is representative of one or more computing systems and/or devices that may implement the various techniques described herein. This is illustrated through inclusion of the display content overlay system 2004, which can be the display content overlay system 1902 discussed above. The computing device 2002 may be, for example, a device associated with a client (e.g., a client device), an on-chip system, and/or any other suitable computing device or computing system.

The example computing device 2002 as illustrated includes a processing system 2004, one or more computer-readable media 2006, and one or more I/O interface 2008 that are communicatively coupled, one to another. Although not shown, the computing device 2002 may further include a system bus or other data and command transfer system that couples the various components, one to another. A system bus can include any one or combination of different bus structures, such as a memory bus or memory controller, a peripheral bus, a universal serial bus, and/or a processor or local bus that utilizes any of a variety of bus architectures. A variety of other examples are also contemplated, such as control and data lines.

The processing system 2004 is representative of functionality to perform one or more operations using hardware. Accordingly, the processing system 2004 is illustrated as including hardware element 2010 that may be configured as processors, functional blocks, and so forth. This may include implementation in hardware as an application specific integrated circuit or other logic device formed using one or more semiconductors. The hardware elements 2010 are not limited by the materials from which they are formed or the processing mechanisms employed therein. For example, processors may be comprised of semiconductor(s) and/or transistors (e.g., electronic integrated circuits (ICs)). In such a context, processor-executable instructions may be electronically-executable instructions. the processing system 2004 can include, for example, a display processor 402, a display processor 1002, a display processor 1102, or a display processor 1202 as discussed above.

The computer-readable storage media 2006 is illustrated as including memory/storage 2012. The memory/storage 2012 represents memory/storage capacity associated with one or more computer-readable media. The memory/storage component 2012 may include volatile media (such as random access memory (RAM)) and/or nonvolatile media (such as read only memory (ROM), Flash memory, optical disks, magnetic disks, and so forth). The memory/storage component 2012 may include fixed media (e.g., RAM, ROM, a fixed hard drive, and so on) as well as removable media (e.g., Flash memory, a removable hard drive, an optical disc, and so forth). The computer-readable media 2006 may be configured in a variety of other ways as further described below.

Input/output interface(s) 2008 are representative of functionality to allow a user to enter commands and information to computing device 2002, and also allow information to be presented to the user and/or other components or devices using various input/output devices. Examples of input devices include a keyboard, a cursor control device (e.g., a mouse), a microphone, a scanner, touch functionality (e.g., capacitive or other sensors that are configured to detect physical touch), a camera (e.g., which may employ visible or non-visible wavelengths such as infrared frequencies to recognize movement as gestures that do not involve touch), and so forth. Examples of output devices include a display device (e.g., a monitor or projector), speakers, a printer, a network card, tactile-response device, and so forth. Thus, the computing device 2002 may be configured in a variety of ways as further described below to support user interaction.

Various techniques may be described herein in the general context of software, hardware elements, or program modules. Generally, such modules include routines, programs, objects, elements, components, data structures, and so forth that perform particular tasks or implement particular abstract data types. The terms "module," "functionality," and "component" as used herein generally represent software, firmware, hardware, or a combination thereof. The features of the techniques described herein are platform-independent, meaning that the techniques may be implemented on a variety of commercial computing platforms having a variety of processors.

An implementation of the described modules and techniques may be stored on or transmitted across some form of computer-readable media. The computer-readable media may include a variety of media that may be accessed by the computing device 2002. By way of example, and not limitation, computer-readable media may include "computer-readable storage media" and "computer-readable signal media."

"Computer-readable storage media" refers to media and/or devices that enable persistent and/or non-transitory storage of information in contrast to mere signal transmission, carrier waves, or signals per se. Computer-readable storage media is non-signal bearing media. The computer-readable storage media includes hardware such as volatile and non-volatile, removable and non-removable media and/or storage devices implemented in a method or technology suitable for storage of information such as computer readable instructions, data structures, program modules, logic elements/circuits, or other data. Examples of computer-readable storage media may include, but are not limited to, RAM, ROM, EEPROM, flash memory or other memory technology, CD-ROM, digital versatile disks (DVD) or other optical storage, hard disks, magnetic cassettes, magnetic tape, magnetic disk storage or other magnetic storage devices, or other storage device, tangible media, or article of manufacture suitable to store the desired information and which may be accessed by a computer.

"Computer-readable signal media" refers to a signal-bearing medium that is configured to transmit instructions to the hardware of the computing device 2002, such as via a network. Signal media typically may embody computer readable instructions, data structures, program modules, or other data in a modulated data signal, such as carrier waves, data signals, or other transport mechanism. Signal media also include any information delivery media. The term "modulated data signal" means a signal that has one or more of its characteristics set or changed in such a manner as to encode information in the signal. By way of example, and not limitation, communication media include wired media such as a wired network or direct-wired connection, and wireless media such as acoustic, RF, infrared, and other wireless media.

As previously described, hardware elements 2010 and computer-readable media 2006 are representative of modules, programmable device logic and/or fixed device logic implemented in a hardware form that may be employed in some implementations to implement at least some aspects of the techniques described herein, such as to perform one or more instructions. Hardware may include components of an integrated circuit or on-chip system, an application-specific integrated circuit (ASIC), a field-programmable gate array (FPGA), a complex programmable logic device (CPLD), and other implementations in silicon or other hardware. In this context, hardware may operate as a processing device that performs program tasks defined by instructions and/or logic embodied by the hardware as well as a hardware utilized to store instructions for execution, e.g., the computer-readable storage media described previously.

Combinations of the foregoing may also be employed to implement various techniques described herein. Accordingly, software, hardware, or executable modules may be implemented as one or more instructions and/or logic embodied on some form of computer-readable storage media and/or by one or more hardware elements 2010. The computing device 2002 may be configured to implement particular instructions and/or functions corresponding to the software and/or hardware modules. Accordingly, implementation of a module that is executable by the computing device 2002 as software may be achieved at least partially in hardware, e.g., through use of computer-readable storage media and/or hardware elements 2010 of the processing system 2004. The instructions and/or functions may be executable/operable by one or more articles of manufacture (for example, one or more computing devices 2002 and/or processing systems 2004) to implement techniques, modules, and examples described herein.

The techniques described herein may be supported by various configurations of the computing device 2002 and are not limited to the specific examples of the techniques described herein. This functionality may also be implemented all or in part through use of a distributed system, such as over a "cloud" 2014 via a platform 2016 as described below.

The cloud 2014 includes and/or is representative of a platform 2016 for resources 2018. The platform 2016 abstracts underlying functionality of hardware (e.g., servers) and software resources of the cloud 2014. The resources 2018 may include applications and/or data that can be utilized while computer processing is executed on servers that are remote from the computing device 2002. Resources 2018 can also include services provided over the Internet and/or through a subscriber network, such as a cellular or Wi-Fi network.

The platform 2016 may abstract resources and functions to connect the computing device 2002 with other computing devices. The platform 2016 may also serve to abstract scaling of resources to provide a corresponding level of scale to encountered demand for the resources 2018 that are implemented via the platform 2016. Accordingly, in an interconnected device embodiment, implementation of functionality described herein may be distributed throughout the system 2000. For example, the functionality may be implemented in part on the computing device 2002 as well as via the platform 2016 that abstracts the functionality of the cloud 2014.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. A method for displaying, using a system, a digital content overlay over a background scene, the method comprising:

sequencing the system through a first state, a second state, and a third state, the first state including a display screen of the system being in an emissive state and a diffuser element of the system being in a scatter state for displaying emitted light images, the second state including the display screen being in a masking state and the diffuser element being in a transparent state for acting as a see-through window to the background scene;

displaying, while in the first state, one or more emitted light images of video content on the display screen;

displaying, while in the second state, one or more transparency mask images of the video content on the display screen, each transparency mask image having approximately a same shape as one of the one or more emitted light images to block the background scene at approximately a same area as the one of the one or more emitted light images;

displaying, while in the third state, one or more translucency images that control a transparency of the display screen;

using a first set of video buffers and a second set of video buffers to store video data for the display screen, the first set of video buffers including a first color frame buffer to store data describing a first color frame of a first emitted light image, a first alpha frame buffer to store data describing a first transparency mask image that corresponds to the first color frame, and a first translucency frame buffer to store data describing a first translucency image of the video content, the second set of video buffers including a second color frame buffer to store data describing a second color frame of a second emitted light image, a second alpha frame buffer to store data describing a second transparency mask image that corresponds to the second color frame, and a second translucency frame buffer to store data describing a second translucency image of the video content; and switching between using the first set of video buffers to display the first emitted light image, the first transparency mask image, and the first translucency image, and using the second set of video buffers to display the second emitted light image, the second transparency mask image, and the second translucency image.

2. The method as recited in claim 1, each transparency mask image having approximately a same location on the display screen as one of the one or more emitted light images.

3. The method as recited in claim 1, the switching comprising switching every other vertical sync.

4. The method as recited in claim 1, wherein the first set of video buffers and the second set of video buffers are to store video data for display to a left eye of a user but not a right eye of the user, the method further comprising:

using a third set of video buffers and a fourth set of video buffers to store video data for the display screen to a right eye of the user but not the left eye of the user, the third set of video buffers including a third color frame buffer to store data describing a third color frame of a third emitted light image, a third alpha frame buffer to store data describing a third transparency mask image that corresponds to the third color frame, and a third translucency frame buffer to store data describing a third translucency image of the video content, the fourth set of video buffers including a fourth color frame buffer to store data describing a fourth color frame of a fourth emitted light image, a fourth alpha frame buffer to store data describing a fourth transparency mask image that corresponds to the fourth color frame, and a fourth translucency frame buffer to store data describing a fourth translucency image of the video content; and switching from using the third set of video buffers to display the third emitted light image, the third transparency mask image, and the third translucency image, and using the fourth set of video buffers to display the fourth emitted light image, the fourth transparency mask image, and the fourth translucency image.

5. The method as recited in claim 1, the sequencing including sequencing through the first state, the second state, the third state, and a fourth state, the fourth state including the display screen being in a masking state and the diffuser element being in the transparent state, the switching between using the first set of video buffers and the second set of video buffers comprising:

switching between using the first set of video buffers to display the first emitted light image, the first transparency mask image, the first translucency image, and a black image, and using the second set of video buffers to display the second emitted light image, the second transparency mask image, the second translucency image, and the black image.

6. The method as recited in claim 1, the first transparency mask image being synchronized to a time of display of the first transparency mask image rather than synchronized to the first color frame of the first emitted light image, and the second transparency mask image being synchronized to a time of display of the second transparency mask image rather than synchronized to the second color frame of the emitted light image.

7. The method as recited in claim 1, further comprising increasing a transparency of a portion of the transparency mask image to make a corresponding portion of the emitted light image appear brighter.

8. The method as recited in claim 1, the diffuser element comprising a segmented diffuser element, the method further comprising synchronizing changes to pixel values of the display screen with changes to pixel states in the segmented diffuser element.

9. The method as recited in claim 1, the first set of video buffers and the second set of video buffers being included in a display processor, the first color frame including one or more pixels in a particular area set to one color to indicate to set the diffuser element to the scatter state with no direct software link between the display processor and the diffuser element, and set to a different color to indicate to set the diffuser element to the transparent state with no direct software link between the display processor and the diffuser element.

10. A display processor for controlling a display system, the display processor comprising:

a first set of video buffers including a first color frame buffer to store data describing a first color frame of a first emitted light image, a first alpha frame buffer to store data describing a first transparency mask image that corresponds to the first color frame, and a first camera frame buffer to store data for a black image;

a second set of video buffers including a second color frame buffer to store data describing a second color frame of a second emitted light image, a second alpha frame buffer to store data describing a second transparency mask image that corresponds to the second color frame, and a second camera frame buffer to store data for the black image;

a controller that switches between using the first set of video buffers to display the first emitted light image, the first transparency mask image, and the black image, and using the second set of video buffers to display the second emitted light image, the second transparency mask image, and the black image;

a display screen manager to sequence a display screen of the display system through a first state, a second state, and a third state, the first state including the display screen being in an emissive state, the second state including the display screen being in a masking state, and the third state including the display being in the emissive state, the display screen displaying an emitted light image of video content while in the first state, displaying a transparency mask image of the video data while in the second state, and displaying the black image in the third state, the transparency mask image having approximately a same shape as the emitted light image; and a diffuser element manager to sequence a diffuser element of the display system through the first state, the second state, and the third state, the first state including the diffuser element being in a scatter state, the second state including the diffuser element being in a transparent state, and the third state including the diffuser element being in the transparent state.

11. The display processor as recited in claim 10, each transparency mask image having approximately a same location on the display screen as one of the one or more emitted light images.

12. The display processor as recited in claim 10, wherein the first set of video buffers and the second set of video buffers are to store video data for display to a left eye of a user but not a right eye of the user, the display processor further comprising:

a third set of video buffers including a third color frame buffer to store data describing a third color frame of a third emitted light image, a third alpha frame buffer to store data describing a third transparency mask image that corresponds to the third color frame, and a third camera frame buffer to store data for the black image, the third emitted light image and the third transparency mask image for the display screen to the right eye of the user but not the left eye of the user;

the fourth set of video buffers including a fourth color frame buffer to store data describing a fourth color frame of a fourth emitted light image, a fourth alpha frame buffer to store data describing a fourth transparency mask image that corresponds to the fourth color frame, and a fourth camera frame buffer to store data for the black image, the fourth emitted light image and the fourth transparency mask image for the display screen to the right eye of the user but not the left eye of the user; and the controller being further to switch from using the third set of video buffers to display the third emitted light image, the third transparency mask image, and the black image, and using the fourth set of video buffers to display the fourth emitted light image, the fourth transparency mask image, and the black image.

13. The display processor as recited in claim 10, wherein the first set of video buffers further includes a first translucency frame buffer to store data describing a first translucency image of the video content, the second set of video buffers further includes a second translucency frame buffer to store data describing a second translucency image of the video content, the controller being to switch between using the first set of video buffers to display the first emitted light image, the first transparency mask image, the black image, and the first translucency image, and using the second set of video buffers to display the second emitted light image, the second transparency mask image, the black image, and the second translucency image.

14. The display processor as recited in claim 10, the first transparency mask image being synchronized to a time of display of the first transparency mask image rather than synchronized to the first color frame of the first emitted light image, and the second transparency mask image being synchronized to a time of display of the second transparency mask image rather than synchronized to the second color frame of the emitted light image.

15. The display processor as recited in claim 10, further comprising the first transparency mask image having an increased transparency to make a corresponding portion of the first emitted light image appear brighter.

16. The display processor as recited in claim 10, the first color frame including one or more pixels in a particular area set to one color to indicate to set the diffuser element to the scatter state, and set to a different color to indicate to set the diffuser element to the transparent state.

17. A computing device for displaying, using a display system, a digital content overlay over a background scene, the computing device comprising:

a processor;

a display processor including a first set of video buffers and a second set of video buffers;

the first set of video buffers including a first color frame buffer to store data describing a first color frame of a first emitted light image and a first alpha frame buffer to store data describing a first transparency mask image that corresponds to the first color frame, the first color frame including one or more pixels in a particular area set to one color to indicate a scatter state for a diffuser element;

the second set of video buffers including a second color frame buffer to store data describing a second color frame of a second emitted light image and a second alpha frame buffer to store data describing a second transparency mask image that corresponds to the second color frame, the one or more pixels in the particular area set to a different color to indicate to a transparent state for the diffuser element; and computer-readable storage media having stored thereon multiple instructions that, responsive to execution by the processor, cause the processor to perform operations including:

sequencing the display system between a first state and a second state, the first state including a display screen of the system being in an emissive state and a diffuser element of the system being in the scatter state for displaying emitted light images, the second state including the display screen being in a masking state and the diffuser element being in the transparent state for acting as a see-through window to the background scene, the sequencing including switching the diffuser element between the scatter state and the transparent state based on a phototransistor sensing the one or more pixels in the particular area with no direct software link between the display processor and the diffuser element;

displaying, while in the first state, one or more emitted light images of video content on the display screen;

displaying, while in the second state, one or more transparency mask images of the video content on the display screen, each transparency mask image having approximately a same shape as one of the one or more emitted light images to block the background scene at approximately a same area as the one of the one or more emitted light images; and switching between using the first set of video buffers to display both the first emitted light image and the first transparency mask image and using the second set of video buffers to display both the second emitted light image and the second transparency mask image.

18. The computing device as recited in claim 17, wherein the first set of video buffers further includes a first translucency frame buffer to store data describing a first translucency image of the video content, the second set of video buffers further includes a second translucency frame buffer to store data describing a second translucency image of the video content, the sequencing including sequencing through the first state, the second state and a third state, the switching between using the first set of video buffers and the second set of video buffers comprising:

switching between using the first set of video buffers to display the first emitted light image, the first transparency mask image, and the first translucency image, and using the second set of video buffers to display the second emitted light image, the second transparency mask image, and the second translucency image.

19. The computing device as recited in claim 17, the sequencing including sequencing through the first state, the second state and a third state, the third state including the display screen being in a masking state and the diffuser element being in the transparent state, the switching between using the first set of video buffers and the second set of video buffers comprising:

switching between using the first set of video buffers to display the first emitted light image, the first transparency mask image, and a black image, and using the second set of video buffers to display the second emitted light image, the second transparency mask image, and the black image.

20. The computing device as recited in claim 17, the first transparency mask image being synchronized to a time of display of the first transparency mask image rather than synchronized to the first color frame of the first emitted light image, and the second transparency mask image being synchronized to a time of display of the second transparency mask image rather than synchronized to the second color frame of the emitted light image.

* * * * *